US011219321B2

(12) United States Patent
Coyle, Jr. et al.

(10) Patent No.: US 11,219,321 B2
(45) Date of Patent: Jan. 11, 2022

(54) HANGING SYSTEM AND BRACKET THEREOF

(71) Applicant: MCS Industries, Inc., Easton, PA (US)

(72) Inventors: Robert Terry Coyle, Jr., Palmer, PA (US); Richard Joseph Ehrhardt, Easton, PA (US)

(73) Assignee: MCS Industries, Inc.

( * ) Notice: Subject to any disclaimer, the term of this patent is extended or adjusted under 35 U.S.C. 154(b) by 175 days.

(21) Appl. No.: 16/292,615

(22) Filed: Mar. 5, 2019

(65) Prior Publication Data

US 2019/0320825 A1 Oct. 24, 2019

Related U.S. Application Data

(63) Continuation of application No. 16/262,063, filed on Jan. 30, 2019.

(Continued)

(51) Int. Cl.

| | |
|---|---|
| ***A47G 1/16*** | (2006.01) |
| ***A47G 1/10*** | (2006.01) |
| ***A47G 1/20*** | (2006.01) |

(52) U.S. Cl.

CPC ..... *A47G 1/1633* (2013.01); *A47G 1/10* (2013.01); *A47G 1/162* (2013.01); *A47G 1/1606* (2013.01);

(Continued)

(58) Field of Classification Search

CPC ..... A47G 1/1606; A47G 1/10; A47G 1/162; A47G 1/0605; A47G 1/101; A47G 1/20;

(Continued)

(56) References Cited

U.S. PATENT DOCUMENTS

| | | | |
|---|---|---|---|
| 1,340,711 | A | 5/1920 | Greenwald |
| 2,010,660 | A | 8/1935 | Ferris |

(Continued)

FOREIGN PATENT DOCUMENTS

| | | | | |
|---|---|---|---|---|
| BE | 1004375 | A3 * | 11/1992 | ..... A47G 1/101 |
| CN | 1650078 | A | 8/2005 | |

(Continued)

OTHER PUBLICATIONS

International Search Report and Written Opinion of corresponding PCT/US2019/015815, dated May 14, 2019, pp. 1-26.

(Continued)

*Primary Examiner* — Jonathan Liu
*Assistant Examiner* — Taylor L Morris
(74) *Attorney, Agent, or Firm* — Belles Katz LLC

(57) ABSTRACT

A hanging system and a method of hanging a support structure from a support surface. The hanging system may include a support structure and a hanging bracket for hanging the support structure from a support surface such as a wall. The support structure may include a mounting groove that accepts a portion of the hanging bracket to facilitate the coupling therebetween. The support structure may be able to slide side-to-side along the support surface while remaining coupled to the hanging bracket. The hanging system may alternatively, or additionally, include a reinforcement bracket. The reinforcement bracket may serve the dual purpose of holding the various mitered components of the support structure together and facilitating the hanging of the support structure from the support surface.

20 Claims, 29 Drawing Sheets

Related U.S. Application Data

(60) Provisional application No. 62/626,816, filed on Feb. 6, 2018, provisional application No. 62/665,595, filed on May 2, 2018.

(52) U.S. Cl.
CPC ..... *A47G 1/1666* (2013.01); *A47G 1/20* (2013.01); *A47G 1/101* (2019.08); *A47G 1/1686* (2013.01)

(58) Field of Classification Search
CPC .... A47G 1/102; A47G 1/1686; A47G 1/1633; A47G 1/205; A47G 2001/0677; A47G 1/16
See application file for complete search history.

(56) References Cited

U.S. PATENT DOCUMENTS 2,204,862 A 6/1940 Lehman
2,299,443 A * 10/1942 Walmsley ..... A47G 1/1606 248/497
2,448,137 A 8/1948 Cody
2,606,730 A * 8/1952 Bryn ..... A47G 1/162 248/497
2,639,109 A 5/1953 Hoag
2,900,750 A * 8/1959 Buelow ..... A47G 1/0655 40/790
3,254,438 A * 6/1966 Filary ..... A47G 1/0655 248/467
3,255,544 A 6/1966 Bruce
3,552,708 A * 1/1971 Hillstrom ..... A47G 1/162 248/498
3,665,629 A 5/1972 Shore
3,668,798 A 6/1972 Mehl
3,668,799 A * 6/1972 Sharron ..... G09F 1/12 40/759
3,698,114 A 10/1972 Hirsch et al.
3,736,684 A * 6/1973 Grad ..... A47G 1/101 40/782
3,805,862 A * 4/1974 Jirovetz ..... A47G 27/0462 16/16
3,830,278 A 8/1974 Packer
3,861,639 A * 1/1975 Morrill ..... A47G 1/1606 248/489
3,883,974 A 5/1975 Ashton
3,922,806 A 12/1975 Saad
3,946,512 A 3/1976 Shapiro
4,055,909 A 11/1977 Perry
4,078,326 A * 3/1978 Reim ..... A47G 1/162 40/759
4,095,361 A * 6/1978 Ledenican ..... A47G 1/102 40/766
4,120,446 A * 10/1978 Fuemmeler ..... A47G 29/1203 232/17
4,161,977 A 7/1979 Baslow
4,216,597 A 8/1980 Kocina et al.
4,228,982 A 10/1980 Sellera
4,233,765 A 11/1980 O'Mullan et al.
4,235,030 A 11/1980 Astolfi
4,311,295 A * 1/1982 Jamar, Jr. ..... A47G 1/1606 248/222.11
D266,144 S * 9/1982 Wallace ..... A47G 1/06 D8/354
4,348,826 A 9/1982 Reim
4,391,054 A 7/1983 Schovee
4,428,135 A * 1/1984 Sobel ..... A47G 1/102 40/782
4,462,176 A 7/1984 Schovee
4,466,591 A 8/1984 Alonzo
4,478,006 A 10/1984 Johnson, Jr.
RE31,799 E 1/1985 Paskerian
4,499,679 A * 2/1985 Sherman ..... A47G 1/1606 248/466
4,507,884 A 4/1985 Kazanjian
4,531,315 A 7/1985 Sobel
4,538,936 A 9/1985 Zeidl
4,555,432 A * 11/1985 Bossons ..... E04F 13/0851 248/496
4,557,457 A 12/1985 Cockfield et al.
4,571,866 A 2/1986 Cole
4,596,488 A 6/1986 Schendan
4,606,526 A 8/1986 Rabinowitz
4,641,441 A 2/1987 Roth
4,689,906 A 9/1987 Sherman
4,712,761 A 12/1987 Wassell
4,718,184 A 1/1988 Sherman
4,776,117 A 10/1988 Astolfi
4,804,161 A * 2/1989 Wallo ..... A47G 1/164 248/489
4,809,859 A 3/1989 Chung
4,932,146 A 6/1990 Long
4,980,983 A 1/1991 Champley
5,012,601 A 5/1991 Garland et al.
5,058,297 A 10/1991 McGinnis
5,058,353 A 10/1991 Gartner
5,101,586 A 4/1992 Zennedijan
5,178,355 A * 1/1993 Herzig ..... A47G 1/20 248/489
5,189,820 A 3/1993 Komamura
5,220,763 A 6/1993 Armitage
5,249,765 A 10/1993 Garcia
5,255,458 A 10/1993 Piel
5,265,358 A 11/1993 Borod
5,303,895 A * 4/1994 Hart ..... A47G 1/168 248/475.1
5,335,434 A 8/1994 Shultz et al.
5,450,702 A 9/1995 Barnett
5,454,542 A 10/1995 Hart
5,749,558 A * 5/1998 Wallo ..... A47G 1/1633 248/475.1
5,799,429 A 9/1998 Speshyock
5,832,646 A 11/1998 Albin et al.
5,899,427 A 5/1999 Schuite
5,961,090 A * 10/1999 Parkin ..... A47G 1/1606 248/475.1
5,976,663 A 11/1999 Davis
6,032,378 A * 3/2000 Null ..... A47G 1/205 33/42
6,053,468 A * 4/2000 Francis ..... A47G 1/1686 248/475.1
6,095,478 A 8/2000 Barnes
6,095,479 A * 8/2000 Brindisi ..... A47G 1/1613 248/476
6,171,540 B1 * 1/2001 Ibaragi ..... B29C 45/00 248/200
6,179,515 B1 1/2001 Grieser et al.
6,241,210 B1 6/2001 Brindisi
6,286,802 B1 * 9/2001 Munson ..... A47G 1/1606 248/475.1
6,305,112 B1 * 10/2001 Hansen ..... A47G 1/0605 40/743
6,322,039 B1 * 11/2001 De Luccia ..... A47G 1/168 248/222.14
RE37,688 E * 5/2002 Vilims ..... A47G 1/0605 40/757
6,454,235 B1 * 9/2002 O'Banion ..... A47G 1/1606 248/495
6,634,127 B2 10/2003 Bauer
6,682,033 B1 * 1/2004 Cohen ..... A47F 5/0846 248/220.22
6,830,228 B2 12/2004 Ernst
6,962,016 B1 11/2005 Meyer
7,198,244 B2 * 4/2007 Deline ..... A47G 1/1606 24/614
7,309,053 B2 12/2007 Lin
7,313,880 B2 1/2008 Yamagishi
7,587,850 B2 * 9/2009 Vineyard ..... A47G 1/06 40/706
7,708,252 B2 * 5/2010 Vander Berg ..... A47B 96/061 248/544

(56) References Cited

U.S. PATENT DOCUMENTS

| | | | | |
|---|---|---|---|---|
| 7,770,315 | B2 | 8/2010 | Bauer et al. | |
| 7,802,769 | B1 * | 9/2010 | Lindsey | A47G 1/205 248/489 |
| 7,891,124 | B1 * | 2/2011 | Willis | A47G 1/1606 40/757 |
| 8,215,043 | B1 | 7/2012 | Roy | |
| 8,333,026 | B2 * | 12/2012 | Southard | A47G 1/16 40/605 |
| 8,534,627 | B2 | 9/2013 | Kressin | |
| 8,641,001 | B2 * | 2/2014 | Heffernon | F16M 13/02 248/224.8 |
| 8,671,583 | B2 * | 3/2014 | Leonard | G01B 3/04 33/379 |
| 8,793,910 | B2 | 8/2014 | Froio et al. | |
| 8,864,095 | B1 * | 10/2014 | Marks | A47G 1/16 248/495 |
| 9,480,350 | B2 | 11/2016 | Kressin et al. | |
| 9,609,964 | B1 * | 4/2017 | Munson | F16M 13/02 |
| 9,949,581 | B2 | 4/2018 | Kacius et al. | |
| 10,039,394 | B2 | 8/2018 | Pyle et al. | |
| 10,051,982 | B2 * | 8/2018 | Jackson | A47G 1/1613 |
| 10,253,796 | B2 * | 4/2019 | Carroll | E04F 13/0841 |
| 10,349,759 | B2 * | 7/2019 | Wiggins | A47G 1/1606 |
| 10,517,411 | B2 * | 12/2019 | Forrest | A47G 1/02 |
| 10,952,552 | B2 * | 3/2021 | Hernandez | A47G 1/1626 |
| 2003/0038222 | A1 | 2/2003 | Holmes | |
| 2005/0109910 | A1 | 5/2005 | Vander Berg et al. | |
| 2006/0218839 | A1 | 10/2006 | Vineyard | |
| 2007/0023605 | A1 * | 2/2007 | Schlais | A47G 1/205 248/489 |
| 2007/0199181 | A1 | 8/2007 | Eichert et al. | |
| 2007/0210234 | A1 | 9/2007 | Lin | |
| 2008/0163524 | A1 | 7/2008 | Broehl et al. | |
| 2009/0026343 | A1 * | 1/2009 | Bauer | A47G 1/215 248/477 |
| 2009/0165319 | A1 | 7/2009 | Gallien | |
| 2010/0043268 | A1 | 2/2010 | Powell | |
| 2013/0180142 | A1 | 7/2013 | Kressin et al. | |
| 2014/0115935 | A1 | 5/2014 | Mason | |
| 2014/0231604 | A1 * | 8/2014 | Long | A47G 1/1633 248/217.3 |
| 2014/0346310 | A1 * | 11/2014 | Yang | A47G 1/20 248/547 |
| 2014/0360068 | A1 | 12/2014 | Bigoney | |
| 2016/0230926 | A1 | 8/2016 | Marley, Jr. | |
| 2016/0235224 | A1 * | 8/2016 | Yang | A47G 1/22 |
| 2017/0035223 | A1 | 2/2017 | Kressin et al. | |
| 2017/0055730 | A1 | 3/2017 | Krake et al. | |
| 2017/0055732 | A1 | 3/2017 | Krake et al. | |
| 2017/0290449 | A1 | 10/2017 | Snyder | |
| 2017/0367506 | A1 | 12/2017 | Pyle | |
| 2018/0116431 | A1 * | 5/2018 | Thompson | A47G 1/1633 |
| 2018/0238489 | A1 * | 8/2018 | Murphy | A47B 96/067 |
| 2019/0008292 | A1 | 1/2019 | Krake et al. | |
| 2019/0021524 | A1 * | 1/2019 | Yang | A47G 1/20 |
| 2019/0307268 | A1 * | 10/2019 | Stas | A47H 1/144 |
| 2019/0350387 | A1 * | 11/2019 | Bastian | A47G 1/1626 |
| 2020/0281376 | A1 * | 9/2020 | Gallien | A47G 1/1606 |
| 2020/0281377 | A1 | 9/2020 | Pyle | |

FOREIGN PATENT DOCUMENTS

| | | | |
|---|---|---|---|
| CN | 102792095 | A | 11/2012 |
| CN | 107427130 | A | 12/2017 |
| DE | 4016584 | | 2/1991 |
| FR | 2506050 | | 11/1982 |
| GB | 2089207 | | 6/1982 |
| GB | 2127741 | | 4/1984 |
| GB | 2138284 | A | 10/1984 |
| WO | WO7900054 | | 2/1979 |

OTHER PUBLICATIONS

High & mights, 20lb Wall Hanger, https://designedtobestuckup.com/wall-hangers/20lb-wall-hanger. US.

Amazon.com, Hangman Z-Hanger Heavy Duty Mirror, Picture and Panel Hanger—Aluminum: Z-18, https://www.amazon.com/Hangman-Z-Hanger-Mirror-Picture-Aluminum/dp/B000VW5T0I/ref=asc_df_B000VW5T0I/?tag=hyprod-20&linkCode=df0&hvadid=193151859311&hvpos=1o5&hvnetw=g&hvrand=293558049205463793&hvpone=&hvptwo=&hvqmt=&hvdev=c&hvdvcmdl=&hvlocint=&hvlocphy=9007324&hvtargid=pla-308990981248&psc=1. US.

Hangman Products, https://hangmanproducts.com/collections/hanging-solutions/pictures-framed-art. US.

Supplementary European Search Report EP19752049.7 dated Sep. 17, 2021.

First Chinese Office Action 201980013934X dated Sep. 28, 2021.

Chinese Search Report 201980013934X dated Sep. 28, 2021.

* cited by examiner

HANGING SYSTEM AND BRACKET THEREOF

CROSS-REFERENCE TO RELATED APPLICATIONS

The present application is a continuation of U.S. patent application Ser. No. 16/262,063, filed Jan. 30, 2019, which claims priority to: (1) U.S. Provisional Patent Application Ser. No. 62/665,595, filed May 2, 2018; and (2) U.S. Provisional Patent Application Ser. No. 62/626,816, filed Feb. 6, 2018, the entireties of which are incorporated herein by reference.

FIELD

The present invention relates generally to a hanging system, and more specifically to a frame and bracket assembly that facilitate hanging an article from a support surface.

BACKGROUND

People often commemorate their achievements or memorialize life events by placing an article within a frame for display. For example, individuals may frame a diploma for hanging on a wall in their office space. Individuals may also frame various photographs for display throughout their home and office spaces by either hanging such frames on the wall or allowing such frames to stand upright on a horizontal surface such as a desk or table. Furthermore, people often hang mirrors from a wall. There is a noted difficulty in hanging articles of the type noted above from a wall in a level manner. Furthermore, it can be difficult to position a hanging article in the exact desired location. Thus, a need exists for a hanging apparatus that allows for level hanging and seamless repositioning of the article on the wall.

Moreover, frame apparatuses, particularly those used to support mirrors, require many different components to ensure that the frame apparatus is sufficiently reinforced and able to be used by a consumer in a desired manner (i.e., hung from a wall, leaning against a wall, etc.). Specifically, the frame typically includes a channel and one or more corner supports are positioned within the channel along each corner of the frame and glued in place. The corner supports provide support for the frame and particularly assist in holding two mitered sections of the frame together. Next, a corner bracket or plate is secured to each of the corners of the frame using staples or the like to create the finished product. Such frame apparatuses also include hanging features (such as D-rings or the like), chipboard D-ring covers, and dust covers. Thus, such structures are much more complicated to manufacture than it might seem to an ordinary observer. Manufacture of these structures is time consuming and therefore expensive from a labor perspective. Thus, a need exists for a frame apparatus that is reinforced and can be hung from a support surface with minimal parts and therefore minimal cost.

SUMMARY

The invention is directed to a hanging system that includes a support structure and a hanging bracket for hanging the support structure from a support surface such as a wall. The support structure includes a mounting groove that accepts a portion of the hanging bracket to facilitate the coupling therebetween. The support structure may be able to slide side-to-side along the support surface while remaining coupled to the hanging bracket. The hanging system may alternatively, or additionally, include a reinforcement bracket. The reinforcement bracket may serve the dual purpose of holding the various mitered components of the support structure together and facilitating the hanging of the support structure from the support surface.

In one aspect, the invention may be a hanging system comprising: a support structure having a rear surface, the support structure comprising: a rabbet for supporting an article; a mounting channel defined by a floor, a first upstanding wall extending from the floor to the rear surface, and a second upstanding wall extending from the floor to the rear surface, the first upstanding wall separating the mounting channel from the rabbet; and a mounting groove formed into an inner surface of the second upstanding wall, the mounting groove comprising a mounting surface that extends obliquely from the rear surface of the support structure; a hanging bracket comprising a first portion and a second portion that extends obliquely from the first portion, wherein the hanging bracket is configured to be coupled to a support surface with the first portion contacting the support surface and the second portion protruding obliquely from the support surface; and wherein the second portion of the hanging bracket is configured to be positioned within the mounting groove of the support structure to mount the support structure to the hanging bracket and thereby hang the support structure from the support surface.

In another aspect, the invention may be a hanging system comprising: a hanging apparatus comprising: a support structure comprising: a front surface, a rear surface opposite the front surface, and an outer surface extending between the front and rear surfaces; a rabbet; and a mounting groove comprising a mounting surface that extends obliquely from the rear surface towards the front and outer surfaces; and an article located within the rabbet and coupled to the support structure; a hanging bracket comprising: a first portion comprising a bottom end, a top end, a front surface, and a rear surface; and a second portion that extends obliquely from the front surface of the first portion at the top end of the first portion, the second portion having an upper surface that is configured to support the support structure and a lower surface opposite the upper surface; wherein the hanging bracket is configured to be coupled to a support surface with the rear surface of the first portion contacting the support surface and the second portion protruding obliquely from the support surface; and wherein the hanging apparatus is configured to be mounted to the support surface by nesting the second portion of the hanging bracket within the mounting groove of the support structure.

In yet another aspect, the invention may be a method of hanging a support structure from a support surface, the method comprising: making a first mark at a first location on the support surface and a second mark at a second location on the support surface, the first and second marks being in vertical alignment with one another so that a horizontal reference plane intersects both of the first and second marks; drawing a line between the first and second marks; aligning a first opening of a first hanging bracket with the first mark and puncturing the support surface with a first protrusion of the first hanging bracket to hold the first hanging bracket in place on the support surface; aligning a second opening of a second hanging bracket with the second mark and puncturing the support surface with a second protrusion of the second hanging bracket to hold the second hanging bracket in place on the support surface; inserting a first fastener through the first opening of the first hanging bracket and into the support surface to mount the first hanging bracket to the support surface, a portion of the first hanging bracket protruding obliquely from the support surface; inserting a second fastener through the second opening in the second hanging bracket and into the support surface to mount the second hanging bracket to the support surface, a portion of the second hanging bracket protruding obliquely from the support surface; and nesting the portions of the first and second hanging brackets into a mounting groove of the support structure, thereby hanging the support structure from the support surface.

In a further aspect, the invention may be a bracket for hanging a support structure from a support surface, the bracket comprising: a bottom end, a top end, a first lateral edge, and a second lateral edge; and a cross-sectional profile taken along a reference plane that intersects the bottom and top ends and is equidistant to the first and second lateral edges, the cross-sectional profile comprising a vertical portion extending from the bottom end of the hanging bracket to a second end of the vertical portion, a horizontal portion extending from the second end of the vertical portion to a second end of the horizontal portion, and an oblique portion extending from the second end of the horizontal portion to the top end of the hanging bracket.

In a still further aspect, the invention may be a bracket for hanging a support structure from a support surface, the bracket comprising: a first portion comprising a bottom end, a top end, a front surface, and a rear surface; a second portion extending obliquely from the top end of the first portion, the second portion comprising an upper surface configured to mate with a mounting groove of a support structure and a lower surface opposite the upper surface; and a protrusion extending from the rear surface of the first portion of the hanging bracket, the protrusion comprising a pointed tip so that the protrusion can penetrate the support surface to temporarily couple the hanging bracket to the support surface.

In another aspect, the invention may be a hanging system comprising: a support structure comprising: a rabbet for supporting an article; and a mounting groove; at least one reinforcement bracket coupled to the support structure, the reinforcement bracket comprising: a plate having a front surface and a rear surface opposite the front surface; an aperture extending through the plate from the front surface to the rear surface; and first and second mounting elements extending from the rear surface of the plate in a spaced apart manner, at least a portion of each of the first and second mounting elements positioned within the mounting groove of the support structure to couple the reinforcement bracket to the support structure.

In yet another aspect, the invention may be a reinforcement bracket for a support structure, the reinforcement bracket comprising: a plate having a front surface, a rear surface opposite the front surface, and an edge extending between the front and rear surfaces; an aperture extending through the plate from the front surface to the rear surface; and first and second mounting elements extending from the rear surface of the plate in a spaced apart manner, each of the first and second mounting elements comprising a first portion extending perpendicularly from the rear surface of the plate and a second portion extending obliquely from the first portion.

In a further aspect, the invention may be a reinforcement bracket for a support structure, the reinforcement bracket comprising: a plate having a front surface, a rear surface opposite the front surface, and an edge extending between the front and rear surfaces; an aperture extending through the plate from the front surface to the rear surface; first and second mounting elements extending from the rear surface of the plate, the first mounting element being adjacent to a first portion of the edge of the plate and being elongated along a first axis that is parallel to the first portion of the edge, the second mounting element being adjacent to a second portion of the edge of the plate and being elongated along a second axis that is parallel to the second portion of the edge; and wherein the first and second axes are perpendicular to one another.

In a still further aspect, the invention may be a method of assembling a frame comprising: joining a first frame member having a first mounting groove with a second frame member having a second mounting groove at a miter joint; inserting a first mounting element of a reinforcement bracket into the first mounting groove and a second mounting element of a reinforcement bracket into the second mounting groove, the reinforcement bracket comprising an aperture configured to receive a fastener for hanging the frame from a support surface; and securing the reinforcement bracket to the first and second frame members.

In another aspect, the invention may be a hanging system comprising: a support structure comprising: a rabbet for supporting an article; and a mounting groove; a first hanging bracket comprising: a first portion configured to be coupled to a support surface; and a second portion extending obliquely from the first portion; at least one reinforcement bracket coupled to the support structure, the reinforcement bracket comprising: a plate having a front surface and a rear surface opposite the front surface; an aperture extending through the plate from the front surface to the rear surface; and first and second mounting elements extending from the rear surface of the plate, at least a portion of each of the first and second mounting elements positioned within the mounting groove of the support structure to couple the reinforcement bracket to the support structure; wherein the support structure is hung from the support surface by one of: (1) the first hanging bracket, whereby the first portion of the first hanging bracket is coupled to the support surface and the second portion of the first hanging bracket is positioned within the mounting groove of the support structure, the support structure being slidable relative to the first hanging bracket while the second portion of the first hanging bracket remains positioned within the mounting groove; and (2) the reinforcement bracket, whereby a fastener protruding from the support surface extends into the aperture of the reinforcement bracket.

In yet another aspect, the invention may be a hanging system comprising: a support structure comprising: a rabbet for supporting an article; and a mounting groove; at least one first type of hanging bracket comprising: a first portion configured to be coupled to a support surface; and a second portion extending obliquely from the first portion and configured to nest within the mounting groove of the support structure to couple the first type of hanging bracket to the support structure; at least one second type of hanging bracket comprising: a plate having a front surface and a rear surface opposite the front surface; an aperture extending through the plate from the front surface to the rear surface and configured to receive a fastener protruding from the support surface; and first and second mounting elements extending from the rear surface of the plate and configured to nest within the mounting groove of the support structure to couple the second type of hanging bracket to the support structure; and wherein the support structure is configured to be hung from a support surface by one of: (1) the first type of hanging bracket, whereby the support structure can move side-to-side while remaining coupled to the support surface;

and (2) the second type of hanging bracket, whereby the support structure is mounted to the support surface in a stationary position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIGS. 24A and 24B are schematic cross-sectional views illustrating the process of mounting the support structure of FIG. 19 to a support surface;

DETAILED DESCRIPTION

Figure 1:
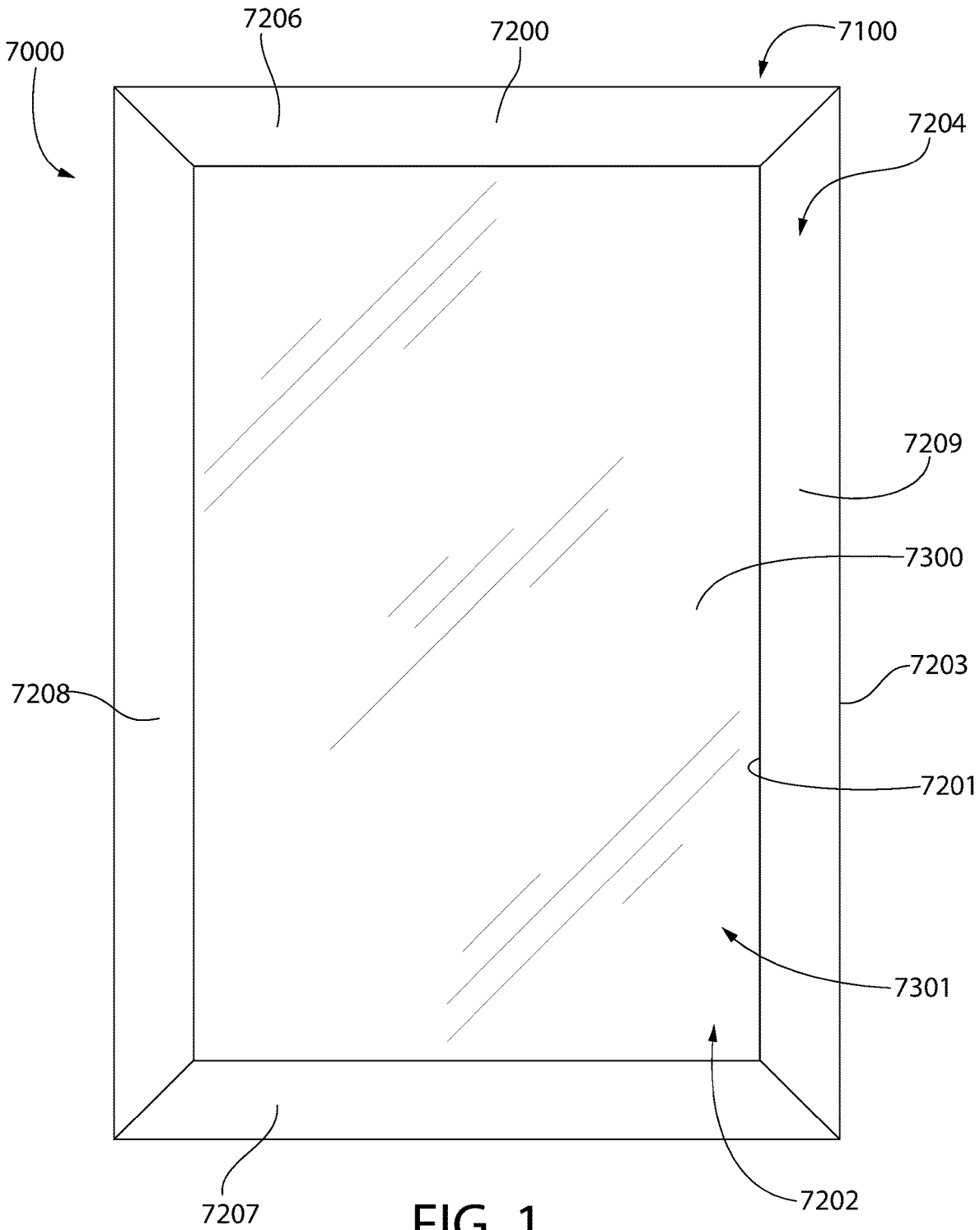
FIG. 1 is a front view of a hanging system in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
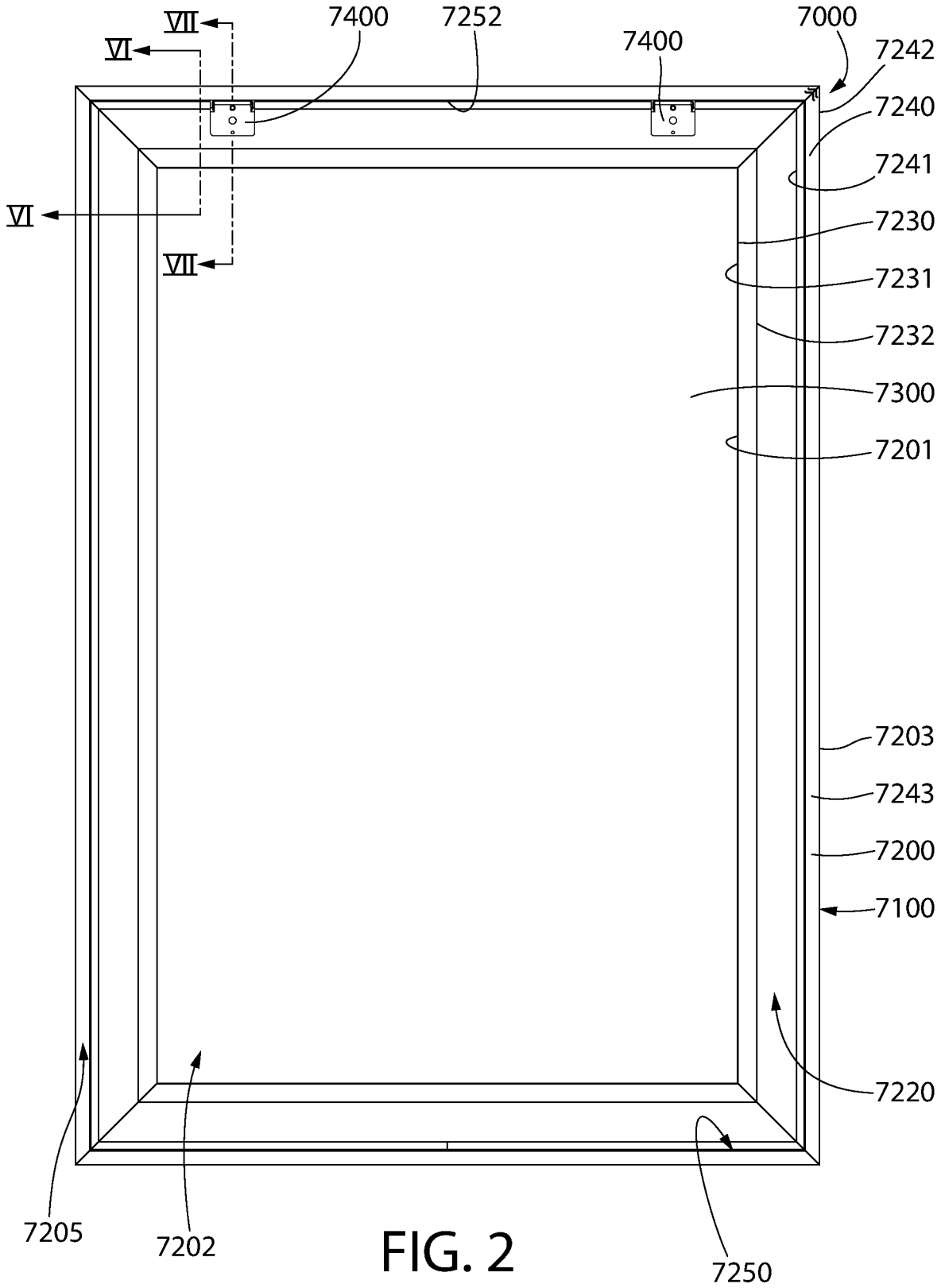
FIG. 2 is a rear view of the hanging system of FIG. 1 illustrating a support structure and a hanging bracket thereof.

Referring to FIGS. 1 and 2 concurrently, a hanging system 7000 is illustrated in a front view and a rear view, respectively, in accordance with an embodiment of the present invention. The hanging system 7000 generally comprises a hanging apparatus 7100 comprising a support structure 7200 and an article 7300 and a hanging bracket 7400 for hanging the hanging apparatus 7100 from a support surface, such as a wall. The support structure 7200 may be considered as a frame in some embodiments. The support structure 7200 comprises an inner surface 7201 that defines a display opening 7202 through which the article 7300 is exposed for viewing and an outer surface 7203 opposite the inner surface 7201. Furthermore, the support structure 7200 comprises a front surface 7204 which is the surface that is exposed when the support structure 7200 is hung from a support surface (such as, but not limited to, a wall) and a rear surface 7205 opposite the front surface 7204. The rear surface 7205 is placed against or into contact with the support surface when the support structure 7200 is hung or otherwise positioned for viewing.

In the exemplified embodiment, the article 7300 is a mirror. In that regard, the mirror has a mirrored surface 7301 that is exposed via the display opening 7202 in the front surface 7204 of the support structure 7200. However, the invention is not to be so limited in all embodiments. Thus, the article 7300 could be any item that is desired to be displayed for viewing by a user. For example, the article 7300 may be a photograph, an artistic rendering, a drawing, a painting, a poster, or the like in alternative embodiments.

The support structure 7200 comprises a first member 7206, a second member 7207, a third member 7208, and a fourth member 7209 that are coupled together to form the support structure 7200. In the exemplified embodiment, each end of each of the first, second, third, and fourth members 7206-7209 is mitered so that the members 7206-7209 are joined together at miter joints. The manner in which the support structure 7200 is assembled in some embodiments will be described in greater detail below with reference to FIGS. 23A-23E. In some embodiments, each of the first, second, third, and fourth members 7206-7209 may be extruded. In other embodiments, each of the first, second, third, and fourth members 7206-7209 may be formed out of wood. In other embodiments, each of the first, second, third, and fourth members 7206-7209 may be formed out of plastic, metal, or other rigid materials as may be desired.

Figure 6:
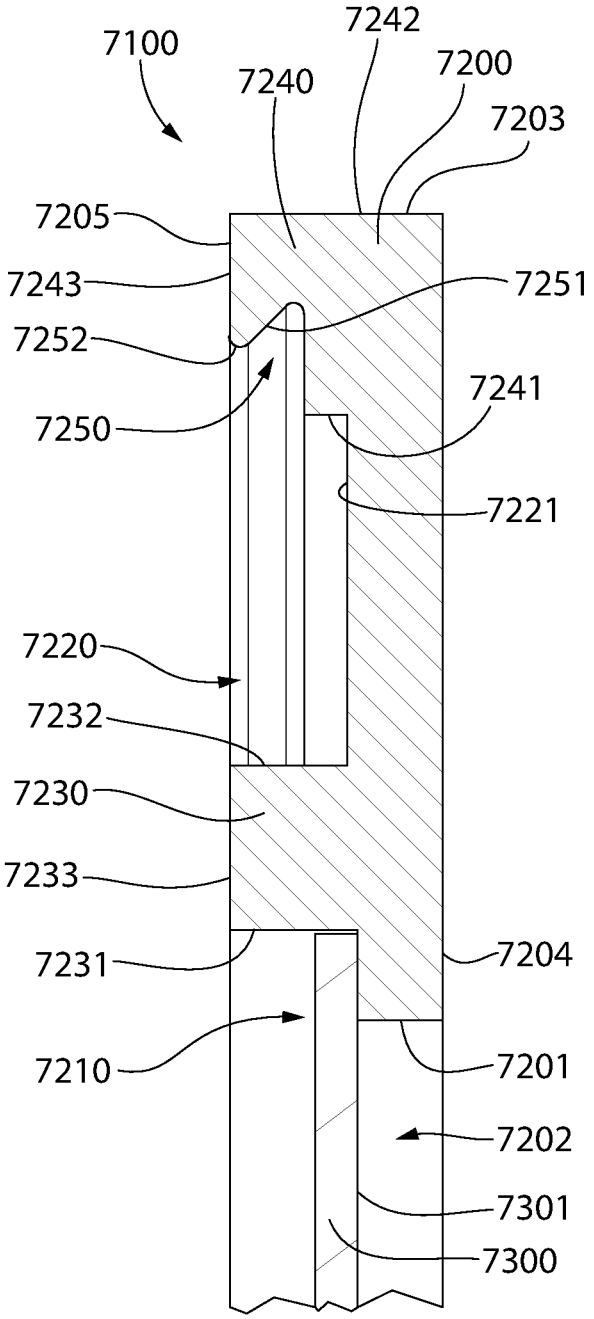
FIG. 6 is a cross-sectional view taken along line VI-VI of FIG. 2.

Referring to FIGS. 2 and 6, the support structure 7200 will be further described. The support structure 7200 comprises a rabbet 7210 for supporting the article 7300 and a mounting channel 7220 for mounting the support structure 7200 to the mounting brackets 7400, as described in more detail below. In the exemplified embodiment, both the rabbet 7210 and the mounting channel 7220 are annular-shaped in that they extend continuously around the entirety of the support structure 7200. The term "annular" is not intended to be limited to round or ring-like shapes, but may include any closed geometric shape including square, rectangular, triangular, pentagonal, and the like. The mounting channel 7220 need not be continuous and annular in all embodiments and may instead comprise spaced apart channel segments in other embodiments. In the exemplified embodiment, the rabbet 7210 and the mounting channel 7220 form a closed-geometry, which in the exemplified embodiment is in the shape of a square but may take on other shapes in other embodiments. The rabbet 7210 and the mounting channel 7220 are separated from one another by a first upstanding wall 7230.

In the exemplified embodiment, the mounting channel 7220 is defined by a profile that is formed directly into the support structure 7200. Specifically, a notch or the like is cut into the support structure 7200 to form the mounting channel 7220. However, the invention is not to be so limited in all embodiments. In alternative embodiments, a separate component may be affixed to the support structure 7200, the separate component having a mounting channel 7220 that is configured to receive a portion of the hanging bracket 7400, as described herein. Thus, a separate component formed from wood, plastic, metal, or the like may be screwed, glued, stapled, or otherwise attached to the support structure 7200, and this separate component may define the mounting channel 7220 that allows coupling of the support structure 7200 to the hanging brackets 7400.

The rabbet 7210 is defined by a floor 7211 and an inner surface 7231 of the first upstanding wall 7230. The first upstanding wall 7230 extends from the floor 7211 of the rabbet 7210 to the rear surface 7205 of the support structure 7200. Thus, a distal surface 7233 of the first upstanding wall 7230 forms a portion of the rear surface 7205 of the support structure 7200. A perimeter portion of the article 7300 rests atop the floor 7211 of the rabbet 7210. In some embodiments, an adhesive such as glue or the like may be placed on the floor 7211 of the rabbet 7210 to secure the article 7300 to the support structure 7200 within the rabbet 7210. When the article 7300 is a mirror as described herein, adhesively coupling the mirror to the support structure 7200 may be the desired assembly process because it tends to be the best technique to ensure that the mirror is securely coupled to the article 7300 and that the mirror does not break. In other embodiments, securing elements may be used to secure the article 7300 to the support structure 7200 within the rabbet 7210, such as flex tabs, glazier points, framer points, clips, turn buttons, or the like. In some embodiments, both securing elements such as frame points and adhesive/glue may be used to secure the article 7300 to the support structure 7200.

While the inner surface 7231 of the first upstanding wall 7230 faces the rabbet 7210, an outer surface 7232 of the first upstanding wall 7230 that is opposite the inner surface 7231 faces the mounting channel 7220. The support structure 7200 also comprises a second upstanding wall 7240. The second upstanding wall 7240 comprises an inner surface 7241 that faces the mounting channel 7220 and an outer surface 7242 that forms the outer surface 7203 of the support structure 7200. The first and second upstanding walls 7230, 7240 are entirely spaced apart from one another. More specifically, the inner surface 7241 of the second upstanding wall 7240 faces the outer surface 7232 of the first upstanding wall, although these two surfaces are entirely separated from one another by the mounting channel 7220. The second upstanding wall 7240 extends from a floor 7221 of the mounting channel 7220 to a distal surface 7243 that forms a portion of the rear surface 7205 of the support structure 7200. Thus, the mounting channel 7220 is defined by the floor 7221, which is recessed relative to the rear surface 7205 of the support structure 7200, the outer surface 7232 of the first upstanding wall 7230, and the inner surface 7241 of the second upstanding wall 7240. In the exemplified embodiment, the floor 7221 is planar. However, in other embodiments the floor 7221 may have a curved contour such that the floor 7221 may be concave or convex (see, for example, FIGS. 8A and 8B described briefly below).

In the exemplified embodiment, a mounting groove 7250 is formed into the inner surface 7241 of the second upstanding wall 7240 for facilitating the hanging of the support structure 7200 from the hanging brackets 7400, as will be described further below. Thus, the mounting groove 7250 is located between the outer surface 7203 of the support structure 7200 and the rabbet 7210. In other embodiments, it may be possible to form the mounting groove 7250 into the inner surface 7231 of the first upstanding wall 7230. In such embodiments, the mounting channel 7220 may be omitted in its entirety. However, in one preferred embodiment the mounting channel 7220 that comprises the mounting groove 7250 is maintained such that the wall of the rabbet 7210 formed by the inner surface 7231 of the first upstanding wall 7230 is not used for mounting of the support structure 7200 to the hanging brackets 7400.

The mounting groove 7250 comprises a mounting surface 7251 that extends obliquely from the rear surface 7205 of the support structure 7200 in a direction towards the front surface 7204 and the outer surface 7203 of the support structure 7200. The mounting surface 7251 of the mounting groove 7250 and the rear surface 7205 of the support structure 7200 meet or intersect at an edge 7252 of the support structure 7200. In the exemplified embodiment, the mounting surface 7251 and the rear surface 7205 intersect at an acute angle which may be between 30° and 60°, or more specifically between 40° and 50°. Of course, other angles can be used in other embodiments as determined by the manufacturer of the support structure 7200 and the hanging bracket 7400 so long as they are designed to interact with each other for mounting the support structure 7200 to the hanging bracket 7400. The mounting surface 7251 forms a part (or the entirety as with FIGS. 8A and 8B) of bounding surface for the mounting channel 7220.

In the exemplified embodiment, there are two of the hanging brackets 7400 coupled to the support structure 7200. The hanging brackets 7400 are used to mount or otherwise hang the support structure 7200 (or the hanging apparatus 7100) to a support surface such as a wall or the like. The support surface may be any surface to which it is desired to hang the hanging apparatus 7100. Thus, the support surface can be a wall, a door, a surface of a cabinet, or the like as may be desired. Although two of the hanging brackets 7400 are being used in the exemplified embodiment, in other embodiments it may be possible to hang the hanging apparatus 7100 from the support surface using just one of the hanging brackets 7400. In still other embodiments, depending on the dimensions of the support structure 7200, more than two of the hanging brackets 7400 may be used. The use of two or more hanging brackets 7400 enables the hanging apparatus 7100 to be moved side-to-side while remaining mounted on the hanging brackets 7400 which remain coupled to the support surface to adjust the exact location on the support surface at which the hanging apparatus 7100 is hung.

Referring to FIGS. 3A-3E, the hanging bracket 7400 will be described in detail. The hanging bracket 7400 may be an integral structure that is formed from a hard plastic material during an injection molding process. For example, the hanging bracket 7400 may be formed from acrylonitrile butadiene styrene (ABS) in some embodiments. In other embodiments, the hanging bracket 7400 may be formed from a metal material such as steel (e.g., carbon steel such as, for example without limitation, SAE 1020 or equivalent), aluminum, copper, or the like. Of course, the hanging bracket 7400 may also be formed of other materials, such as for example without limitation other hard plastics, wood, or the like. The hanging bracket 7400 should be formed of a rigid material to facilitate coupling of the hanging bracket 7400 to a support surface and the mounting of the support structure 7200 to the hanging bracket 7400 as described herein. If desired, the hanging bracket 7400 may also comprise a plating material, such as electroless nickel plating, to give the hanging bracket 7400 a desired exterior appearance.

The hanging bracket 7400 comprises a bottom end 7401 and a top end 7402. The hanging bracket 7400 generally comprises a first portion 7410 extending from a bottom end 7411 to a top end 7412 and a second portion 7420 extending upwardly from the top end 7411 of the first portion 7410 at an oblique angle relative to the first portion 7410. Specifically, the first portion 7410 of the hanging bracket 7400 extends from the bottom end 7401 of the hanging bracket 7400 to the top end 7412 of the first portion 7410 along a first axis B-B and the second portion 7420 of the hanging bracket 7400 extends from the top end 7412 of the first portion 7410 of the hanging bracket 7400 to the top end 7402 of the hanging bracket 7400 along a second axis C-C that is oblique to the first axis B-B. In the exemplified embodiment, the first and second axes B-B, C-C intersect at an angle θ2 of approximately 45°, although the invention is not to be so limited in all embodiments and this angle may be other than that shown without affecting the ability of the hanging bracket 7400 to couple to the support structure 7200 as described herein below. For example, in other embodiments the angle could be approximately 30°, or the angle could be any of the angles noted above for the angle θ2 between the support surface and the rear surface 7205 of the support structure 7200. In some embodiments the angle θ2 should approximately match the angle θ1 between the mounting surface 7252 and the rear surface 7205 of the support structure 7200.

In the exemplified embodiment, the second portion 7420 of the hanging bracket 7400 comprises a first leg 7421 coupled to the top end 7412 of the first portion 7410 and a second leg 7422 coupled to the top end 7412 of the first portion 7410, the first and second legs 7421, 7422 being spaced apart from one another. Furthermore, the hanging bracket 7400 comprises an L-shaped third portion 7430 located between the first and second legs 7421, 7422 of the second portion 7420. The L-shaped third portion 7430 is coupled to the top end 7412 of the first portion 7410 at a location between the first and second legs 7421, 7422. The L-shaped third portion 7430 is also coupled to a portion of the second portion 7420 that extends between the first and second legs 7421, 7422.

Figure 3B:
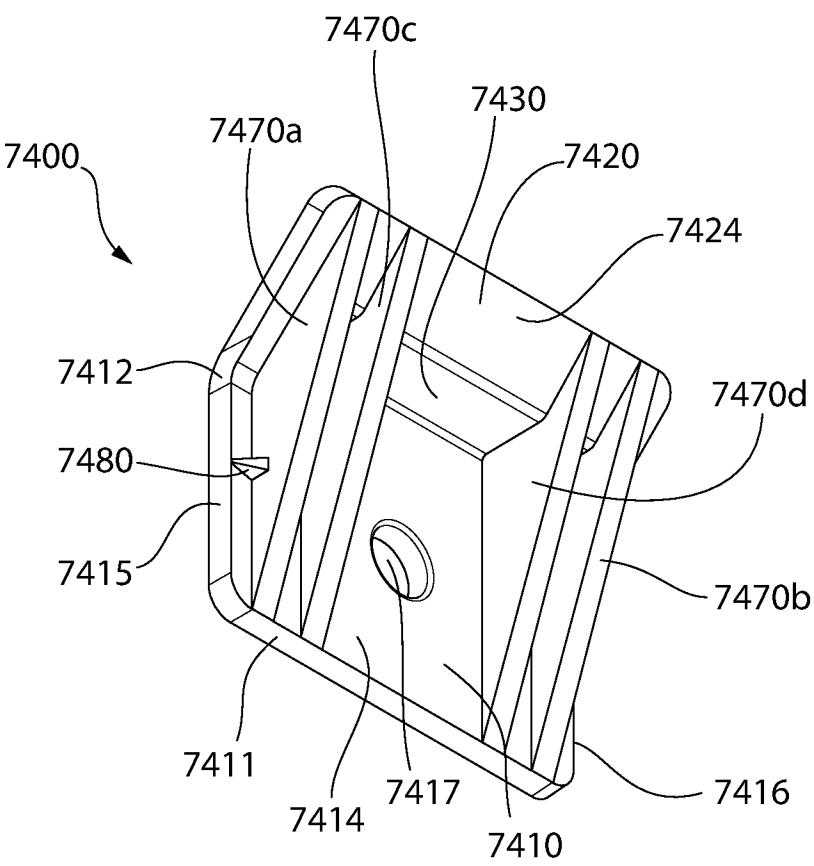
FIGS. 3A-3D are front perspective, rear perspective, side, and bottom views, respectively, of the hanging bracket of the hanging system of FIG. 2.
Figure 3A:
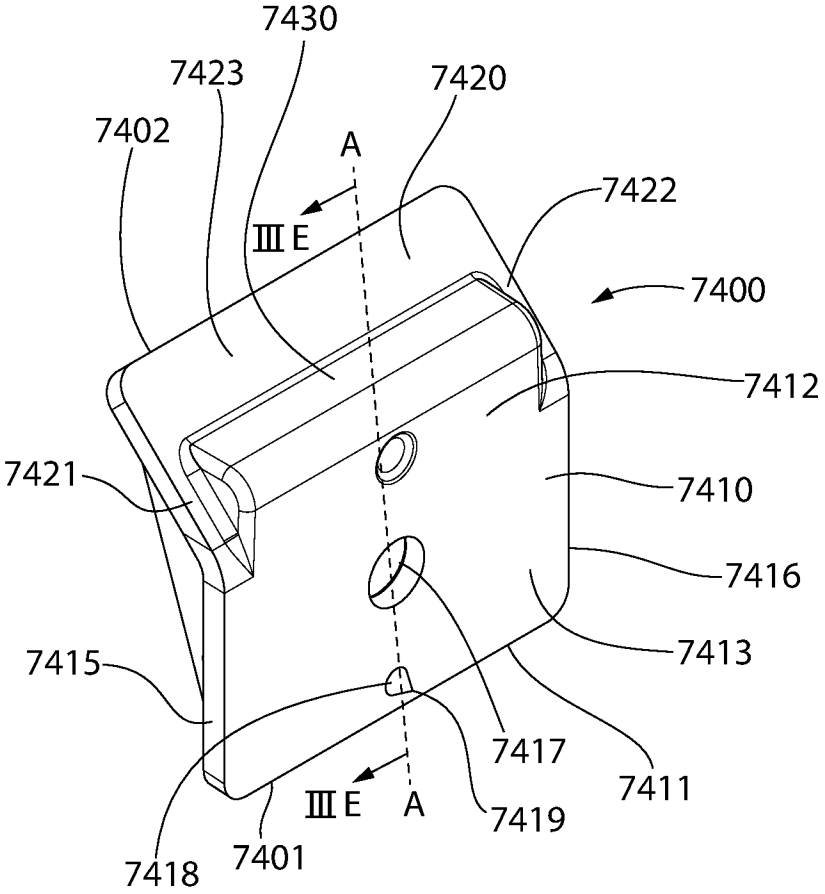
Figure 3C:
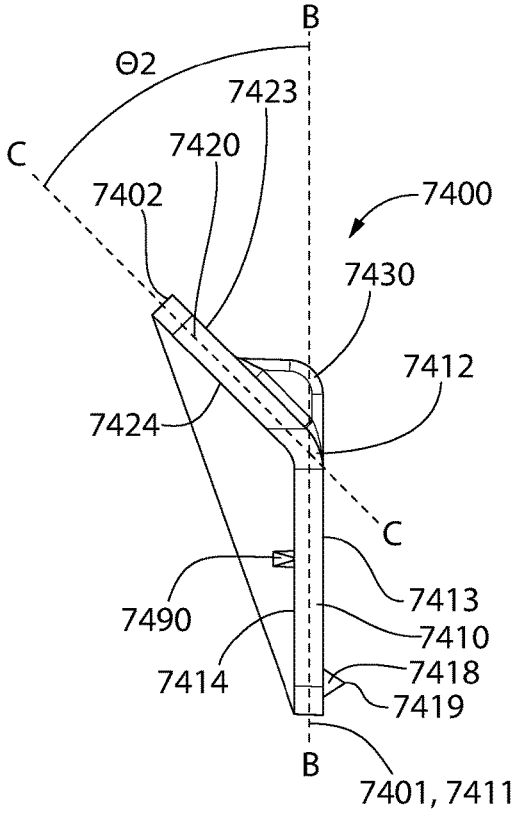
Figure 3D:
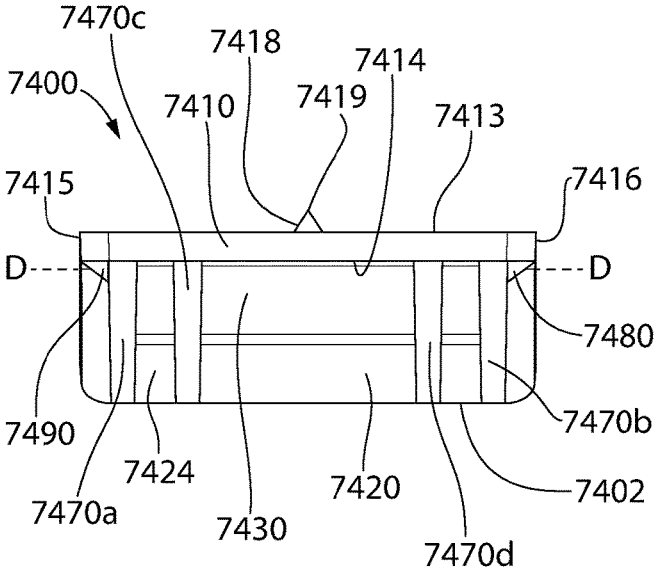
Figure 3E:
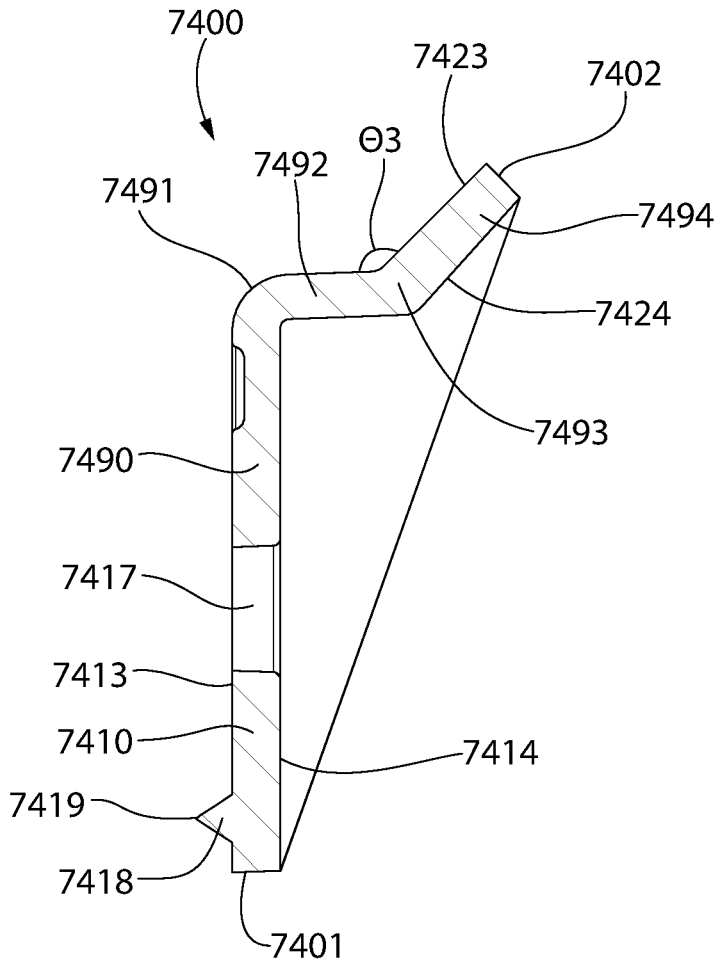
FIG. 3E is a cross-sectional view taken along line IIIE-IIIE of FIG. 3A.

Stated another way and with particular reference to FIG. 3E, the hanging bracket 7400 comprises a cross-sectional profile taken along a reference plane A-A that intersects the bottom and top ends 7401, 7402 of the hanging bracket 7400. The reference plane A-A is also located equidistantly between the first and second lateral edges 7415, 7416 of the first portion 7410 of the hanging bracket 7400. In the exemplified embodiment, the reference plane A-A is parallel to the first and second lateral edges 7415, 7416. The cross-sectional profile comprises a vertical portion 7490 extending form the bottom end 7401 of the hanging bracket 7400 to a second end 7491 of the vertical portion 7490, a horizontal portion 7492 extending from the second end 7491 of the vertical portion 7490 to a second end 7493 of the horizontal portion 7492, and an oblique portion 7494 extending from the second end 7493 of the horizontal portion 7492 to the top end 7402 of the hanging bracket 7400. The horizontal portion 7492 extends perpendicularly from the vertical portion 7490. The oblique portion 7494 extends obliquely from the horizontal portion 7492. Specifically, in the exemplified embodiment an angle θ3 between the horizontal portion 7492 and the oblique portion 7492 is an obtuse angle.

The second portion 7420 of the hanging bracket 7400 comprises an upper surface 7423 and a lower surface 7424 opposite the upper surface 7423. The upper surface 7423 is the surface that comes into direct contact with the mounting surface 7251 of the support structure 7200 when the support structure 7200 is mounted to or hanging from the hanging bracket 7400.

Referring again to FIGS. 3A-3E collectively, the first portion 7410 of the hanging bracket 7400 comprises a front surface 7414, a rear surface 7413 opposite the front surface 7414, a first lateral edge 7415, and a second lateral edge 7516 opposite the first lateral edge 7415. Furthermore, the hanging bracket 7400 comprises an opening 7417 extending through the first portion 7410 of the hanging bracket 7400 from the front surface 7414 to the rear surface 7413. In the exemplified embodiment, the opening 7417 is circular in shape, although the invention is not to be so limited in all embodiments. The opening 7417 is configured to receive a fastener such as a screw, a nail, or the like, in order to securely couple the hanging bracket 7400 to a support surface. Specifically, the opening 7417 may receive a body of a screw or nail such that the hanging bracket 7400 is positioned between the head of the screw or nail and the support surface. Thus, the opening 7417 can take on any shape that allows it to effectively receive such a fastener and achieve this function. When the hanging bracket 7400 is coupled to a support surface, the rear surface 7413 of the first portion 7410 is in contact with the support surface and the lower surface 7424 of the second portion 7420 and the front surface 7414 of the first portion 7410 of the hanging bracket 7400 are exposed.

Furthermore, the hanging bracket 7400 also comprises a protrusion (or spike or barb) 7418 extending from the rear surface 7413 of the first portion 7410 to a pointed tip 7419. In the exemplified embodiment, the protrusion 7418 tapers continuously from the rear surface 7413 of the first portion 7410 to the pointed tip 7419. In other embodiments, the protrusion 7418 may taper for only a portion of its length to form the pointed tip 7419. Either way, the pointed tip 7419 should be designed to penetrate the support surface to temporarily couple the hanging bracket 7400 to the support surface. The protrusion 7418 may have a length measured from the rear surface 7413 of the first portion 7410 of the hanging bracket 7400 to the pointed tip 7419 of between 2 mm and 5 mm, more specifically between 3 mm and 4 mm, and still more specifically approximately 3.5 mm.

In the exemplified embodiment, the protrusion 7418 is formed as an integral part of the hanging bracket 7400. Thus, during the injection molding or other process during which the hanging bracket 740 is formed, the protrusion 7418 is also formed. Stated another way, in the exemplified embodiment the hanging bracket 7400 is a monolithic structure that comprises the first and second portions 7410, 7420 and the protrusion 7418. Although only one protrusion 7418 is depicted in the exemplified embodiment, in other embodiments multiple protrusions 7418 may be included on the hanging bracket 7400. In other embodiments still, the protrusion 7418 may not be formed as an integral part of the hanging bracket 7400, but rather the hanging bracket 7400 may include adhesive, hook-and-loop fasteners, or any other component or structure designed to temporarily couple the hanging bracket 7400 to a support surface. In still other embodiments, the protrusion 7418 may be omitted altogether and a fastener can be used in conjunction with the opening 7417 for coupling the hanging bracket 7400 to the support surface.

In accordance with the exemplified embodiment, a user should be able to press the rear surface 7413 of the first portion 7410 of the hanging bracket 7400 into contact with the support surface (i.e., wall) to cause the protrusion 7418 to penetrate the support surface, thereby providing a temporary coupling between the hanging bracket 7400 and the support surface. The term "temporary" is used here because the engagement between the protrusion 7418 and the support surface is not generally sufficient to secure the hanging bracket 7400 to the support surface with sufficient strength such that the hanging bracket 7400 can support the support structure 7200 thereon. Rather, once the hanging bracket 7400 is temporarily held in place using the protrusion 7418, a user will insert a fastener through the opening 7417 to provide a more permanent coupling between the hanging bracket 7400 and the support surface. However, because the protrusion 7418 is holding the hanging bracket 7400 to the support surface, a user need not hold the hanging bracket 7400 in place while attaching the fastener. Rather, the user can focus attention to placement of the fastener through the opening 7417 without concern that the hanging bracket 7400 is going to move out of the desired location.

In the exemplified embodiment, the protrusion 7418 is located near the bottom end 7401 of the hanging bracket 7400. In fact, the hanging bracket 7400 may have a height measured from the bottom end 7401 to the top end 7402 of between approximately 25 mm and 35 mm, more specifically 27 mm and 33 mm, and still more specifically approximately 30 mm. Furthermore, the distance from the bottom end 7401 of the hanging bracket 7400 to the pointed tip 7419 of the protrusion 7418 may be between 1.75 mm and 2.75 mm, more specifically between 2.0 mm and 2.5 mm, and still more specifically approximately 2.25 mm. Stated another way, a ratio of the height of the hanging bracket 7400 to the distance between the bottom end 7401 of the hanging bracket 7400 and the pointed tip 7419 of the protrusion 7418 may be between 10:1 and 16:1, more specifically between 12:1 and 14:1. Thus, the protrusion 7418 is located quite near to the bottom end 7401 of the hanging bracket 7400 in the exemplified embodiment. Of course, other locations for the protrusion 7418 are possible in other embodiments without detracting from its function. Furthermore, although only one protrusion 7418 is illustrated in the exemplified embodiment, the hanging bracket 7400 could include multiple protrusions in other embodiments to make the coupling between the hanging bracket 7400 and the support surface using the protrusion 7418 along more secure.

In the exemplified embodiment, the hanging bracket 7400 comprises a plurality of reinforcement ribs 7470*a-d* that provide an increased strength to the hanging bracket 7400 to enable it to support the support structure 7200 as described herein. Specifically, each of the reinforcement ribs 7470*a-d* is coupled to the lower surface 7424 of the second portion 7420 of the hanging bracket 7400 and to the front surface 7414 of the first portion 7410 of the hanging bracket 7400. As a result, any weight that is supported by the second portion 7420 of the hanging bracket 7400 will be translated across the reinforcement ribs 7470*a-d* and onto the first portion 7410 of the hanging bracket 7400. This prevents the second portion 7420 from breaking when supporting the support structure 7200 as described herein. In the exemplified embodiment, the reinforcement ribs 7470*a-d* are all triangular-like shaped, but they could take on other shapes in other embodiments.

The hanging bracket 7400 further comprises a first visual alignment feature 7480 and a second visual alignment feature 7490 that assist with ensuring that the hanging bracket 7400 is hung in a level manner so that the support structure 7200 will be level when supported by the hanging bracket 7400. The first visual alignment feature 7480 is positioned at or adjacent to the first lateral edge 7415 and the second visual alignment feature 7490 is positioned at or adjacent to the second lateral edge 7416. Furthermore, the first and second visual alignment features 7480, 7490 are in vertical alignment with one another. This means that a horizontal reference plane (such as reference plane D-D shown in FIG. 3D) intersects both of the first and second visual alignment features 7480, 7490.

In the exemplified embodiment, the first visual alignment feature 7480 is a first protuberance and the second visual alignment feature 7490 is a second protuberance. However, the invention is not to be so limited in all embodiments and the first and second visual alignment features 7480, 7490 could be indicia, markings, indents, detents, or the like in other embodiments. Specifically, the first and second visual alignment features 7480, 7490 could be any feature that can be seen by a user to assist a user in properly aligning the hanging bracket 7400 on a wall as described in greater detail below. In the exemplified embodiment, the first visual alignment feature 7480 is a protuberance that extends from an outer surface of the first reinforcement rib 7470*a* in a direction towards the first lateral edge 7415 of the first portion 7410 of the hanging bracket 7400. Similarly, the second visual alignment feature 7490 is a protuberance that extends from an outer surface of the second reinforcement rib 7470*b* in a direction towards the second lateral edge 7416 of the first portion 7410 of the hanging bracket 7400.

In the exemplified embodiment, the distal end of the first visual alignment feature 7480 does not protrude beyond the first lateral edge 7415 and the distal end of the second visual alignment feature 7490 does not protrude beyond the second lateral edge 7416. However, in other embodiments the first and second visual alignment features 7480, 7490 may protrude beyond the first and second lateral edges 7415, 7416, respectively. In fact, in one particular alternative embodiment, the first and second visual alignment features 7480, 7490 may be located on and extend directly from the first and second lateral edges 7415, 7416, respectively.\

The hanging bracket 7400 may have a width measured between the first and second lateral sides 7415, 7416 of between 25 mm and 40 mm, and more specifically between 30 mm and 35 mm. Furthermore, the hanging bracket 7500 may have a height measured between the bottom and top ends 7401, 7402 of between approximately 20 mm and 40 mm, more specifically between 25 mm and 35 mm, and more specifically between 28 mm and 30 mm. Thus, the hanging bracket 7400 is rather small in comparison to the support structure 7200.

Figure 4A:
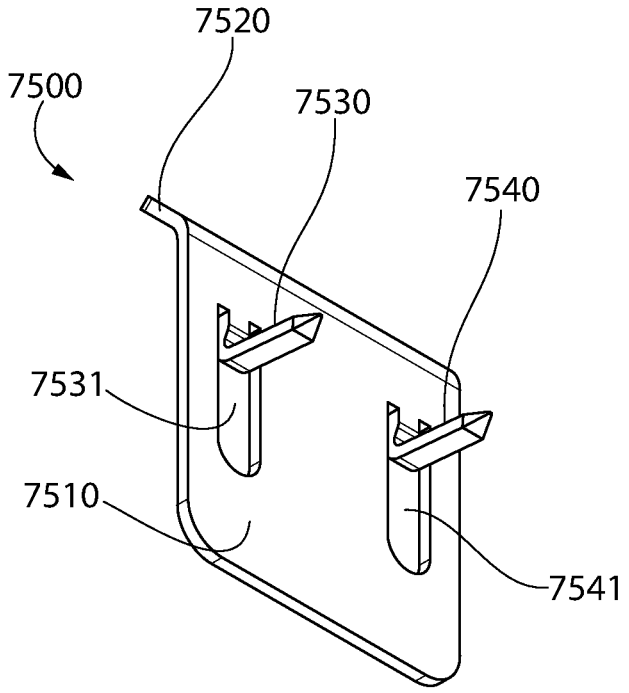
FIGS. 4A and 4B are perspective and side views, respectively, of a hanging bracket in accordance with a first alternative embodiment of the present invention.
Figure 4B:
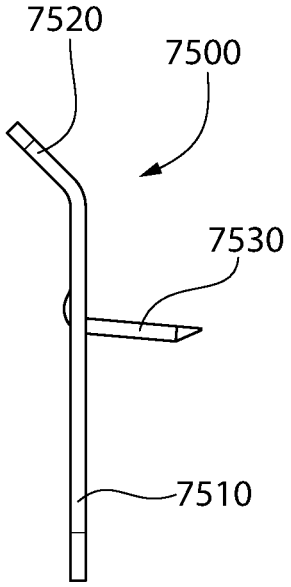

Referring to FIGS. 4A and 4B, a hanging bracket 7500 is illustrated in accordance with an alternative embodiment of the present invention. The hanging bracket 7500 may be formed out of metal or plastic or other materials as described above with regard to the hanging bracket 7400. The hanging bracket 7500 comprises a first portion 7510 and a second portion 7520 that is oriented obliquely relative to the first portion 7510. Furthermore, the hanging bracket 7500 comprises a first protrusion 7530 and a second protrusion 7540 extending from the first portion 7510. The first and second protrusions 7530, 7540 are intended to penetrate a support surface to couple the hanging bracket 7500 to the support surface. In the exemplified embodiment, the first and second protrusions 7530, 7540 are formed by punching an appropriate pattern into the first portion 7510 of the hanging bracket 7500 and subsequently bending the in-plane tab that is formed by the punch into the desired shape. As a result, in the exemplified embodiment the first portion 7510 of the hanging bracket 7400 comprises apertures 7531, 7541 adjacent to the first and second protrusions 7530, 7540. This enables the first and second protrusions 7530, 7540 to be formed integrally with the remainder of the hanging bracket 7400. Of course, other techniques may be used for forming the first and second protrusions 7530, 7540. Fasteners may be inserted into the apertures 7531, 7541 to more securely couple the hanging bracket 7500 to the support surface.

Figure 5A:
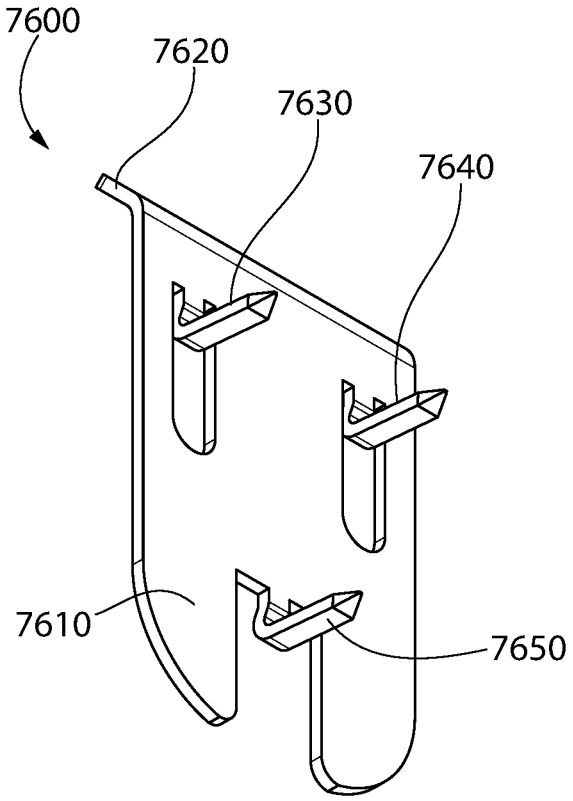
FIGS. 5A and 5B are perspective and side views, respectively, of a hanging bracket in accordance with a second alternative embodiment of the present invention.
Figure 5B:
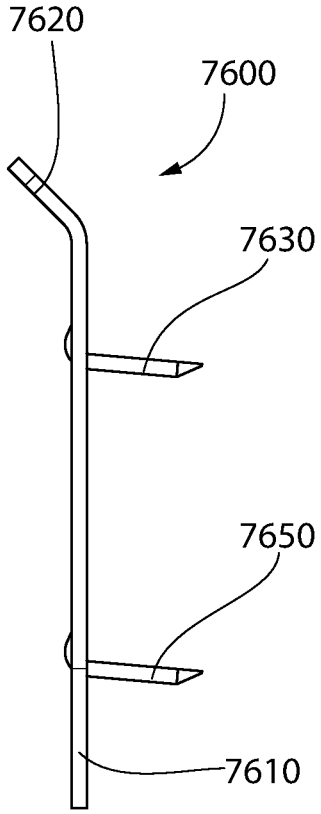

Referring to FIGS. 5A and 5B, a hanging bracket 7600 is illustrated in accordance with another alternative embodiment of the present invention. The hanging bracket 7600 comprises a first portion 7610 and a second portion 7620 extending obliquely from the first portion 7610. The hanging bracket 7600 is identical to the hanging bracket 7500 except that it includes three protrusions 7630, 7640, 7650. Thus, further details of the hanging bracket 7600 will not be provided herein in the interest of brevity, it being understood that the descriptions of the hanging bracket 7500 and the hanging bracket 7400 are applicable.

Figure 7:
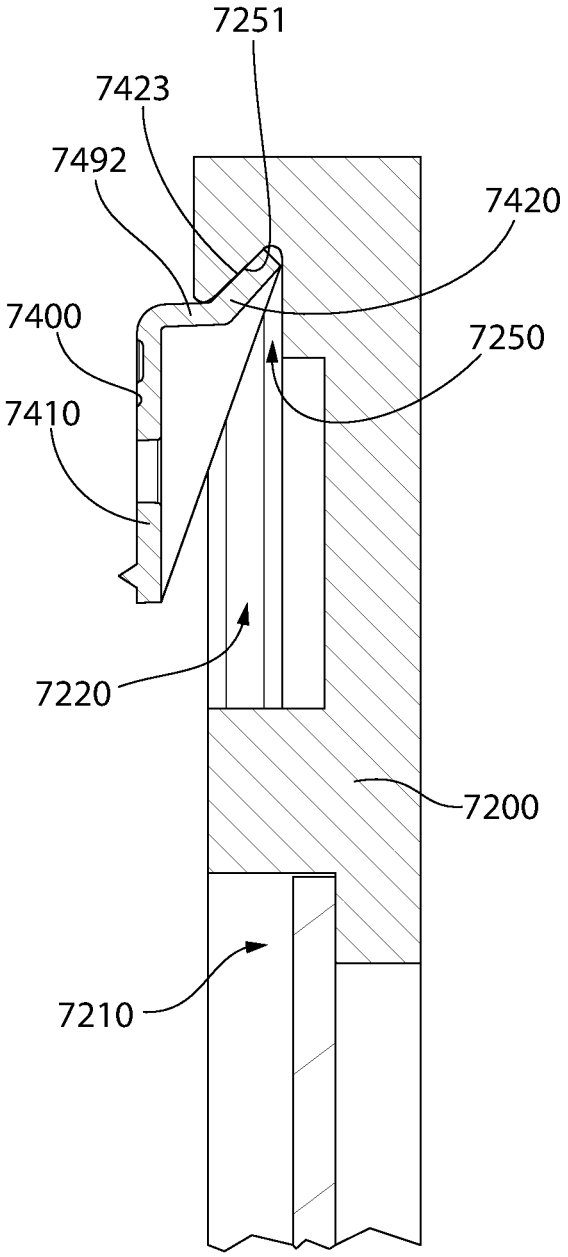
FIG. 7 is a cross-sectional view taken along line VII-VII of FIG. 2.

Referring now to FIGS. 6 and 7, a portion of the hanging system 7000 is illustrated in cross-section whereby FIG. 6 illustrates only the support structure 7200 and FIG. 7 illustrates the support structure 7200 with one of the hanging brackets 7400 coupled thereto. FIG. 6 was described in detail above. As seen in FIG. 7 (which is a cross-section taken along line VII-VII of FIG. 2), the support structure 7200 is coupled to the hanging brackets 7400 by inserting the second portion 7420 of the hanging bracket 7400 into the mounting groove 7250 of the support structure 7200. Specifically, the hanging bracket 7400 is first coupled to the support surface (i.e., wall) as described in more detail below. Next, the support structure 7200 is aligned with the hanging bracket 7400 and then positioned over the hanging bracket 7400 so that the second portion 7420 of the hanging bracket 7400 nests within the mounting groove 7250 of the support structure 7200. When so positioned, the mounting surface 7251 of the mounting groove 7250 rests atop and in surface contact with the upper surface 7423 of the second portion 7420 of the hanging bracket 7400. Furthermore, the edge 7252 at the intersection of the rear surface 7205 of the support structure 7200 and the mounting surface 7251 rests atop the horizontal portion 7492 of the hanging bracket 7400. When the second portion 7420 of the hanging bracket 7400 is nested within the mounting groove 7250 of the support structure 7200, the remainder of the hanging bracket 7400 including the entirety of the first portion 7410 of the hanging bracket 7400 is located external to the mounting channel 7220 of the support structure 7200. Thus, when mounted to a wall or other support surface, the rear surface 7205 of the support structure 7200 is spaced apart from the wall or other support surface, as described more fully herein below.

Figure 8A:
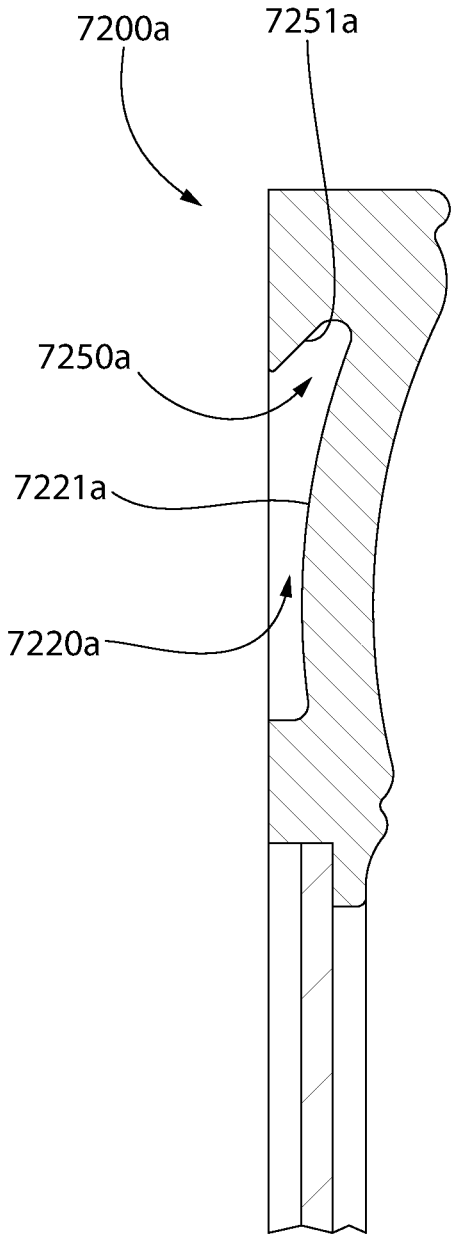
FIGS. 8A and 8B are cross-sectional views taken along line VI-VI of FIG. 2 in accordance with alternative embodiments of the present invention.
Figure 8B:
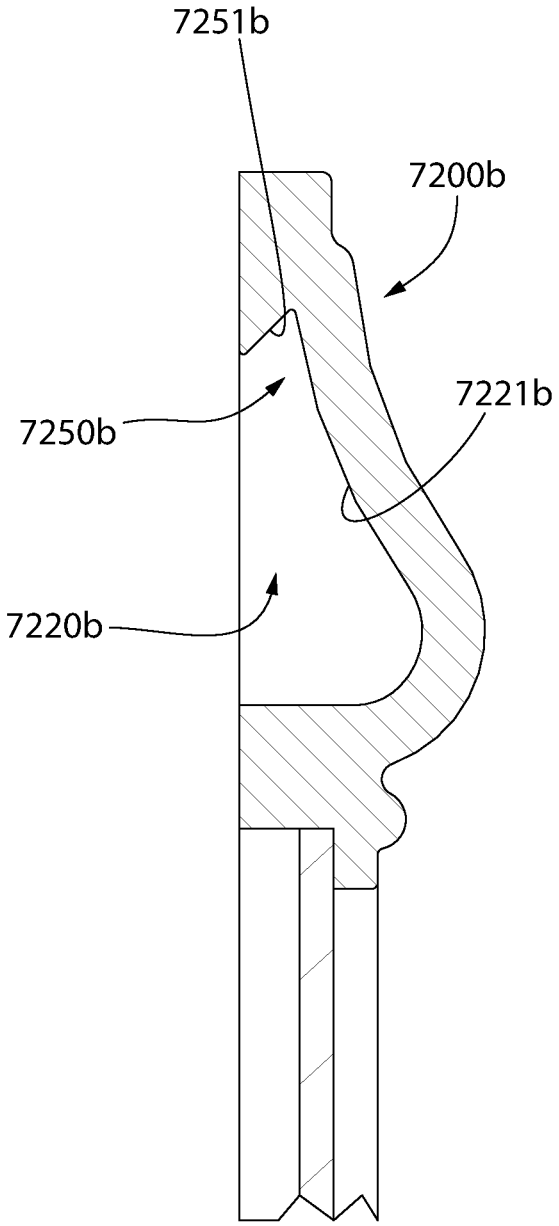

FIGS. 8A and 8B illustrate different profiles that may be used for the support structure 7200, labeled with the suffix "a" and "b" here to distinguish over the previously described embodiment. In FIG. 8A, the support structure 7200*a* comprises a mounting channel 7220*a* comprising a floor 7221*a* that has a convex curvature. In FIG. 8B the support structure 7200*b* comprises a mounting channel 7220*b* comprising a floor 7221*b* that has a concave curvature. Thus, FIGS. 8A and 8B illustrate that the exact configuration and shape of the mounting channel is not limited to that which is shown in FIG. 6, for example, but that it can be modified and still achieve its purpose. Thus, in FIG. 8A the support structure 7200*a* comprises a mounting groove 7250*a* comprising a mounting surface 7251*a* and in FIG. 8B the support structure 7200*b* comprises a mounting groove 7250*b* comprising a mounting surface 7251*b*. These features are generally the same as that which was described above with regard to the support structure 7200. Thus, the support structures 7200*a*, 7200*b* are still configured to interact with and be coupled to the hanging brackets 7400 in the same way as the support structure 7200.

Figure 8C:
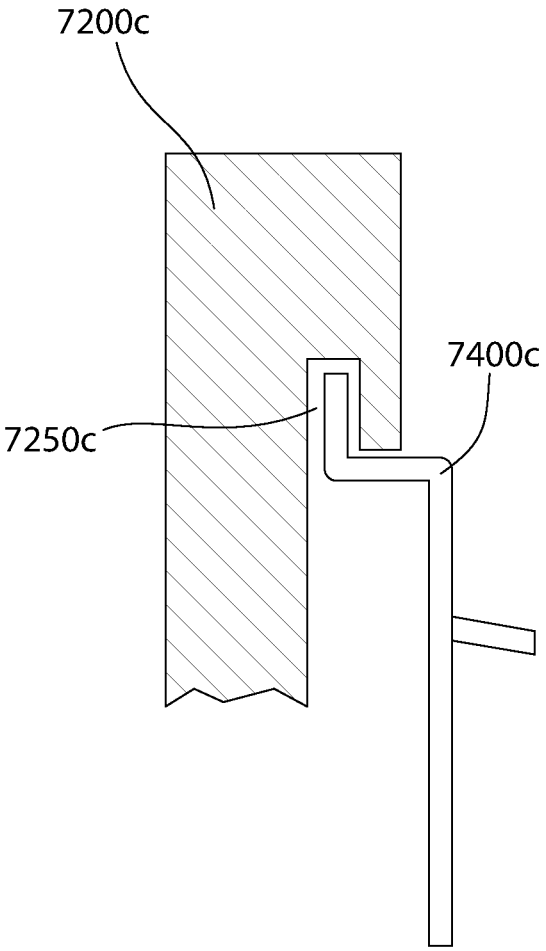
FIGS. 8C and 8D are cross-sectional views taken along line VII-VII of FIG. 2 in accordance with alternative embodiments of the present invention.
Figure 8D:
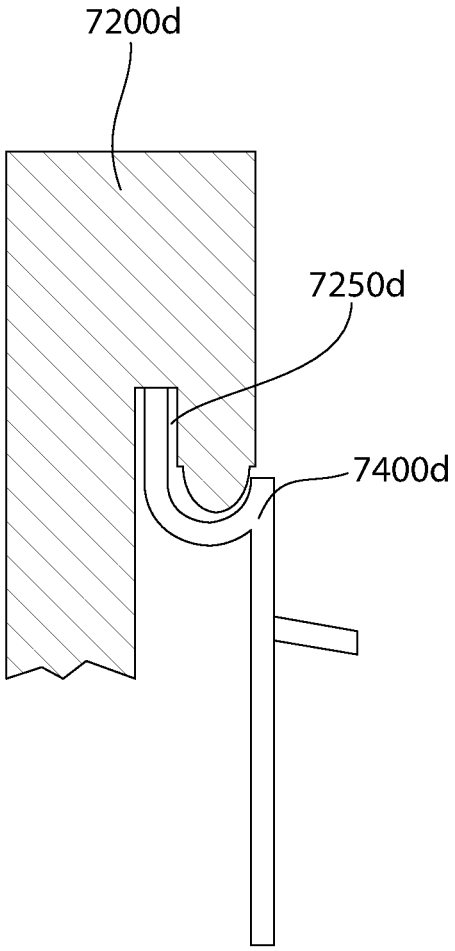

FIG. 8C illustrates yet another embodiment of a support structure 7200*c* and FIG. 8D illustrates still another embodiment of a support structure 7200*d*. In these embodiments, the configuration of the mounting groove 7250*c*, 7250*d* has changed from that which was previously described. That, the mounting grooves 7250*c*, 7250*d* do not have surfaces that extend obliquely from the rear surface of the support structure 7200*c*, 7200*d*. Thus, in these embodiments hanging brackets 7400*c*, 7400*d* having different configurations must be utilized to achieve the coupling between the hanging brackets 7400*c*, 7400*d* and the support structures 7200*c*, 7200*d*, respectively.

Figure 9:
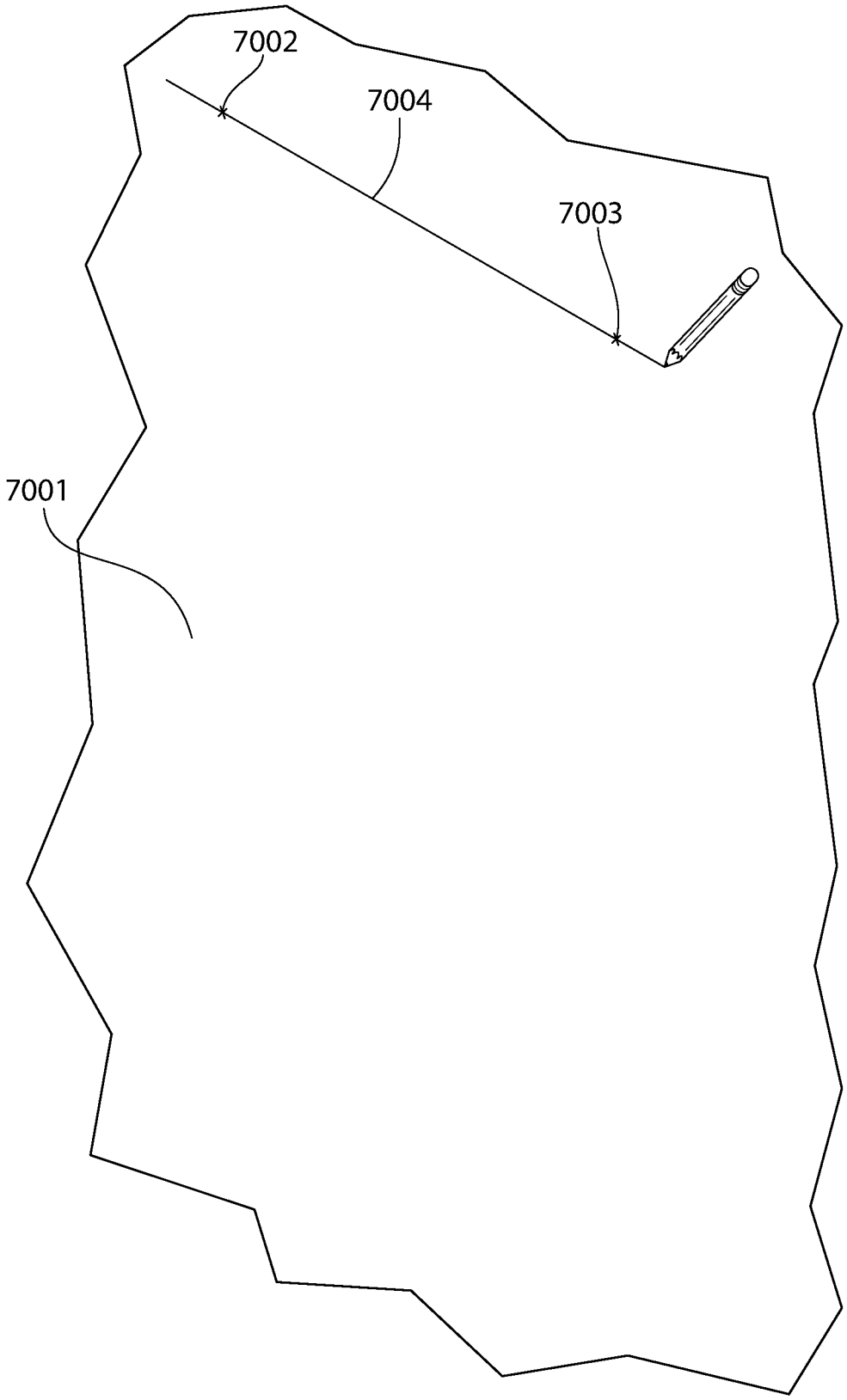
FIG. 9 is a perspective view of a support surface illustrating a line being drawn thereon.

Referring to FIGS. 9-14, the process of coupling the hanging brackets 7400 to a support surface 7001 and then hanging the hanging apparatus 7100 from the hanging brackets 7400 will be described in accordance with an embodiment of the present invention. Referring to FIG. 9, the first step is to determine the appropriate spacing between the two (or more) hanging brackets 7400 that are going to be used to support the hanging apparatus 7100 on the support surface 7001. Next, a user makes a first mark 7002 at a first location on the support surface 7001 and a second mark 7003 at a second location on the support surface 7001. The first and second marks 7002 should be spaced apart the determined distance (which is different depending on the size/dimensions of the support structure 7200 and depending on whether the support structure 7200 is to be hung in portrait or landscape orientation). Next, a user draws a level line 7004 between the first and second marks 7002, 7003. Of course, in other embodiments the user can draw the level line and then make the first and second marks 7002, 7003.

Figure 10:
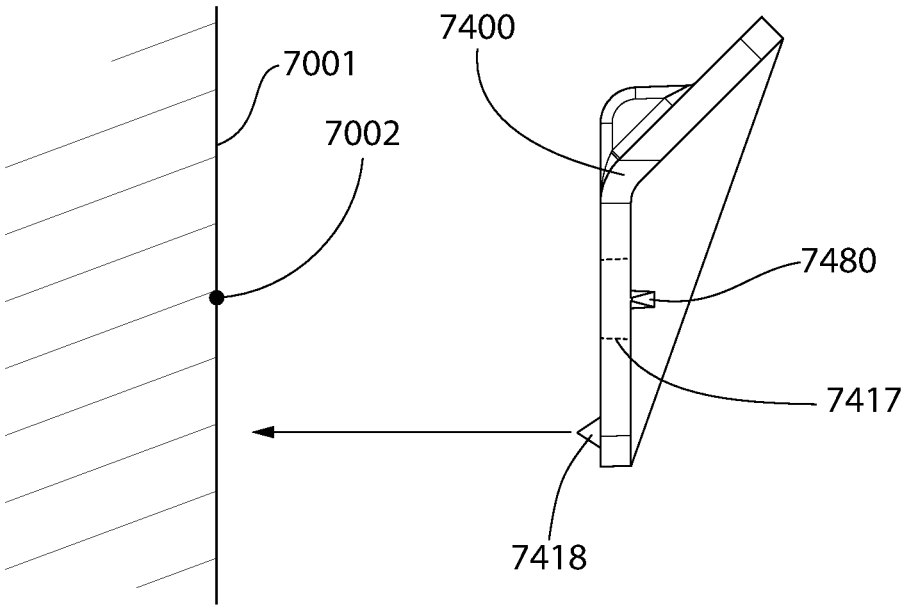
FIGS. 10 and 11 are schematic views illustrating the process of coupling of the hanging bracket of FIGS. 3A-3D to a support surface.

Next, referring to FIG. 10, a user will take one of the hanging brackets 7400 and move it towards the support surface 7001 so that the opening 7417 in the hanging bracket 7400 is aligned with the first mark 7402 on the support surface 7001. The user will also take a second hanging bracket 7400 and align its opening 7417 with the second mark 7403 on the support surface 7001. The user can and should use the first and second visual alignment features 7480, 7490 to assist in ensuring that the hanging brackets 7400 are coupled to the wall in a level manner. Specifically, the user should make sure that both of the first and second visual alignment features 7480, 7490 are aligned with the level line 7004 that the user previously drew (or otherwise marked) on the support surface 7001. As long as the level line 7004 is actually level and the first and second visual alignment features 7480, 7490 are aligned with the level line 7004, the hanging bracket 7400 will be level as well.

Figure 11:
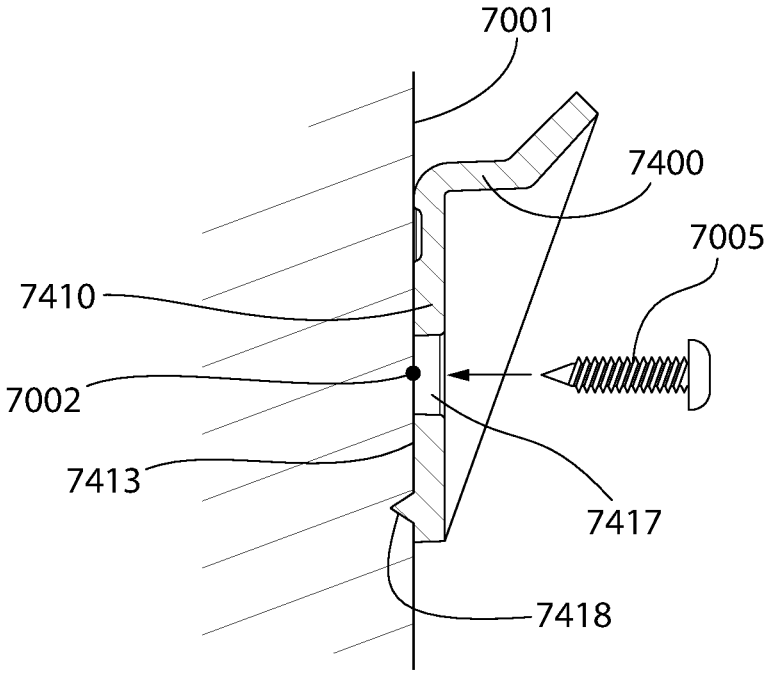

Referring to FIG. 11, the user will press the hanging bracket 7400 against the support surface 7001 so that the rear surface 7413 of the first portion 7410 of the hanging bracket 7400 comes into surface contact with the support surface 7001. As this occurs, the protrusion 7418 of the hanging bracket 7400 penetrates the support surface 7001 to couple the hanging bracket 7400 to the support surface 7001. A user may have to apply some amount of pressure to force the protrusion 7418 to penetrate the support surface 7001. If desired or necessary, a tool such as a hammer may be used to get the protrusion 7418 to penetrate the support surface 7001.

As mentioned previously, this coupling between the hanging bracket 7400 and the support surface 7001 by using the protrusion 7418 alone is not sufficient to enable the hanging bracket 7400 to be weight bearing in some embodiments. In that regard, the opening 7417 in the hanging bracket 7400 is aligned with the first mark 7002 on the support surface 7001. Thus, as shown in FIG. 11, in some embodiments a fastener 7005 such as a screw, a nail, or the like may then be inserted through the opening 7417 in the hanging bracket 7400 and into the support surface 7001 to securely couple the hanging bracket 7400 to the support surface 7001. With the hanging bracket 7400 coupled to the support surface 7001, the second portion 7420 of the hanging bracket 7400 extends obliquely from the support surface 7001 and thereby forms a cleat that facilitates coupling of the support structure 7200 to the hanging bracket 7400 to mount or hang the support structure 7200 from the support surface 7001.

Figure 12:
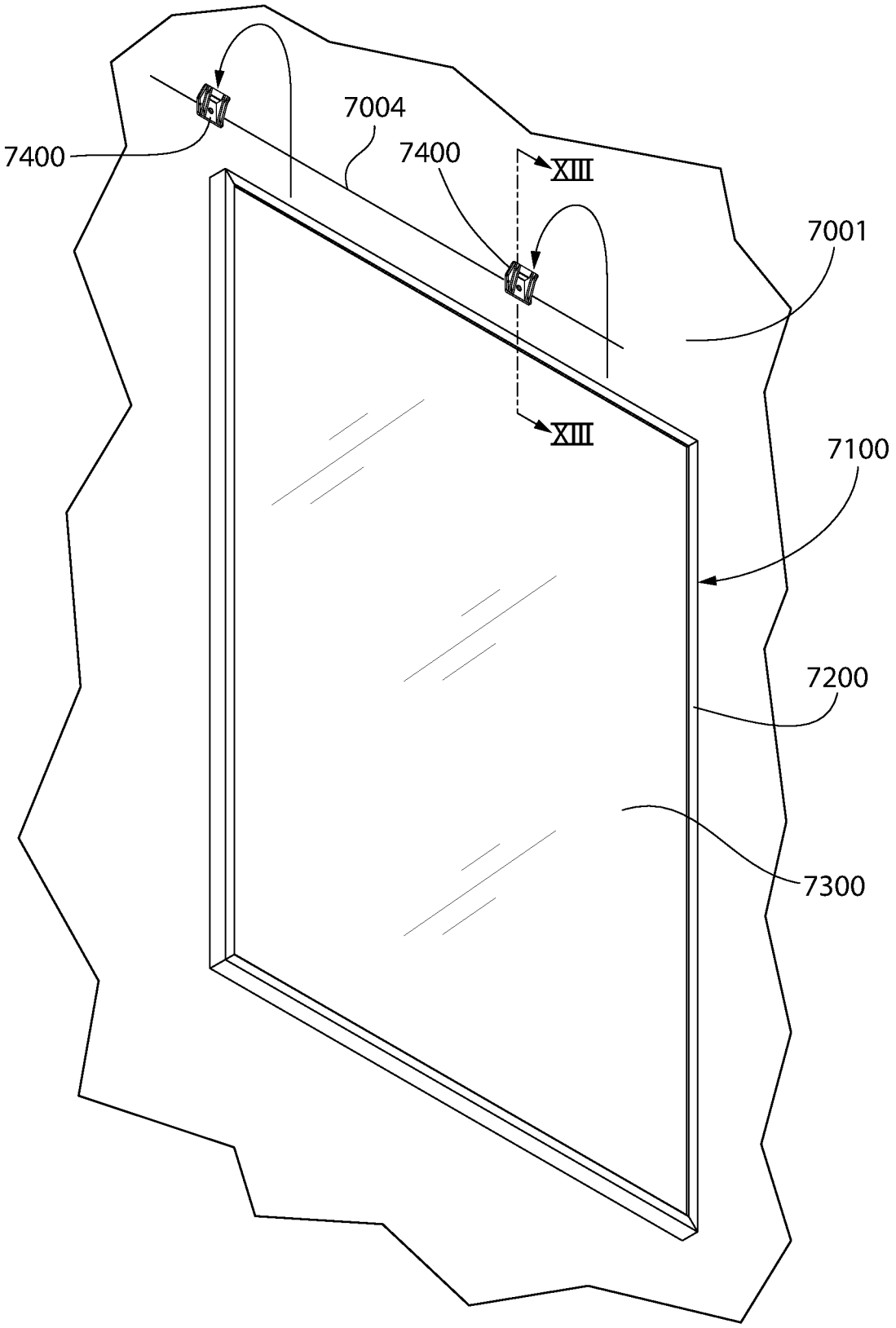
FIG. 12 is a perspective view illustrating the process of coupling the support structure to the hanging brackets to mount the support structure to the support surface.

Referring to FIG. 12, the support surface 7001 is illustrated with two of the hanging brackets 7400 coupled thereto along the level line 7004. Next, the hanging apparatus 7100 is lifted up and brought towards the hanging brackets 7400 with the rear surface 7205 of the support structure 7200 facing the support surface 7001. As soon as the support structure 7200 is coupled to the hanging brackets 7400, the hanging apparatus 7100 will be hanging from the support surface 7001 in a level manner.

Figure 13:
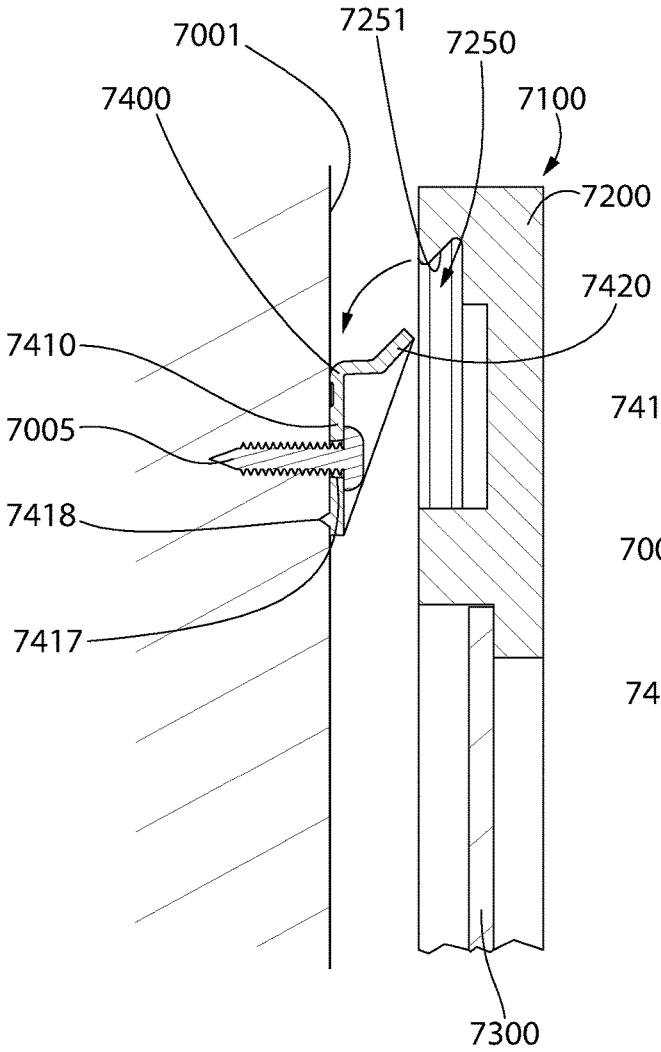
FIG. 13 is a cross-sectional view taken along line XIII-XIII of FIG. 12 illustrating the support structure just prior to being coupled to the hanging brackets.
Figure 14:
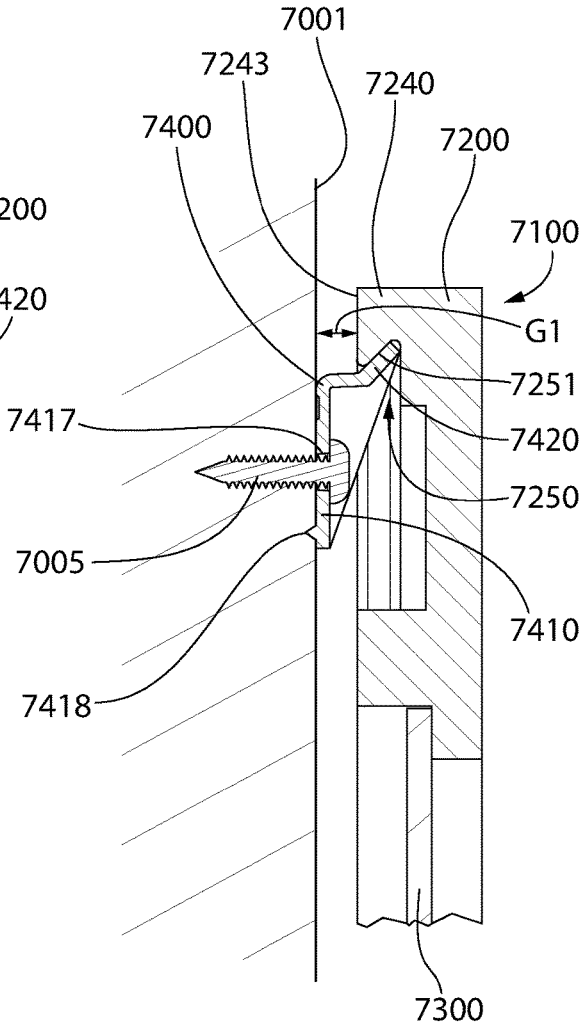
FIG. 14 is the cross-sectional view of FIG. 13 illustrating the support structure coupled to the hanging brackets.

Referring to FIGS. 13 and 14, sectional views of the step of attaching the support structure 7200 to the hanging brackets 7400 are illustrated. The support structure 7200 is moved towards the hanging brackets 7400 and then moved downwardly so that the second portions 7420 of the hanging brackets 7400 enter into and nest within the mounting groove 7250 of the support structure 7200. The interaction between the mounting surface 7251 of the support structure 7200 and the second portion 7420 of the hanging bracket 7400 while the hanging bracket 7400 is coupled to the support surface 7001 results in the support structure 7200 (and more specifically the hanging apparatus 7100) being hung from or mounted to the support surface 7001.

As shown in FIG. 14, due to the configuration of the hanging bracket 7400, the support structure 7200 is maintained at a distance away from the support surface 7001 when the support structure 7200 is coupled to the hanging bracket 7400. Specifically, a gap G1 exists between the rear surface 7243 of the second upstanding wall 7240 of the support structure 7200 and the support surface 7001. This can be beneficial for level hanging if the support surface 7001 is not planar and it can also prevent the support structure 7200 from causing damage to the support surface 7001 due to scraping or the like.

As mentioned previously, when the hanging brackets 7400 are coupled to the mounting groove 7250 of the support structure 7200, the hanging brackets 7400 can slide side-to-side within the mounting groove 7250. Thus, if the hanging brackets 7400 are coupled to the support surface (e.g., wall) 7001 and the support structure 7200 is coupled to the hanging brackets 7400, the support structure 7200 can slide side-to-side along the support surface 7001 while remaining coupled to the hanging brackets 7400. During this side-to-side movement of the support structure 7200, the first portions 7410 of the hanging brackets 7400 remain nested within the mounting groove 7250 of the support structure 7200.

Figure 15A:
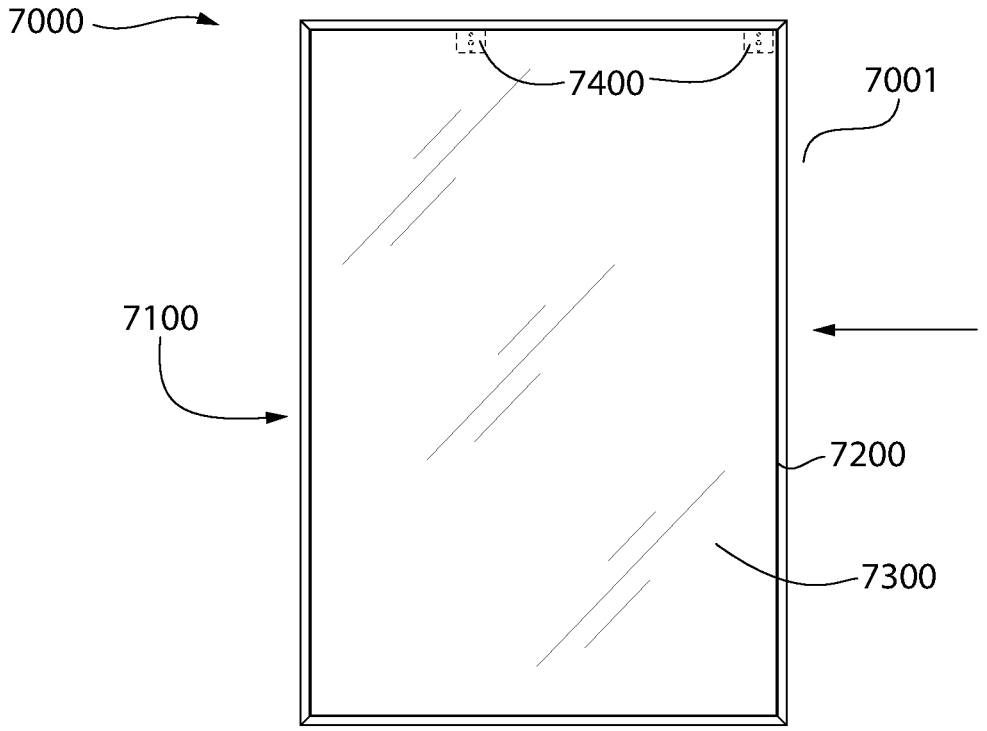
FIGS. 15A and 15B illustrate possible horizontal movement of the support structure while the hanging apparatus hangs from a support surface.
Figure 15B:
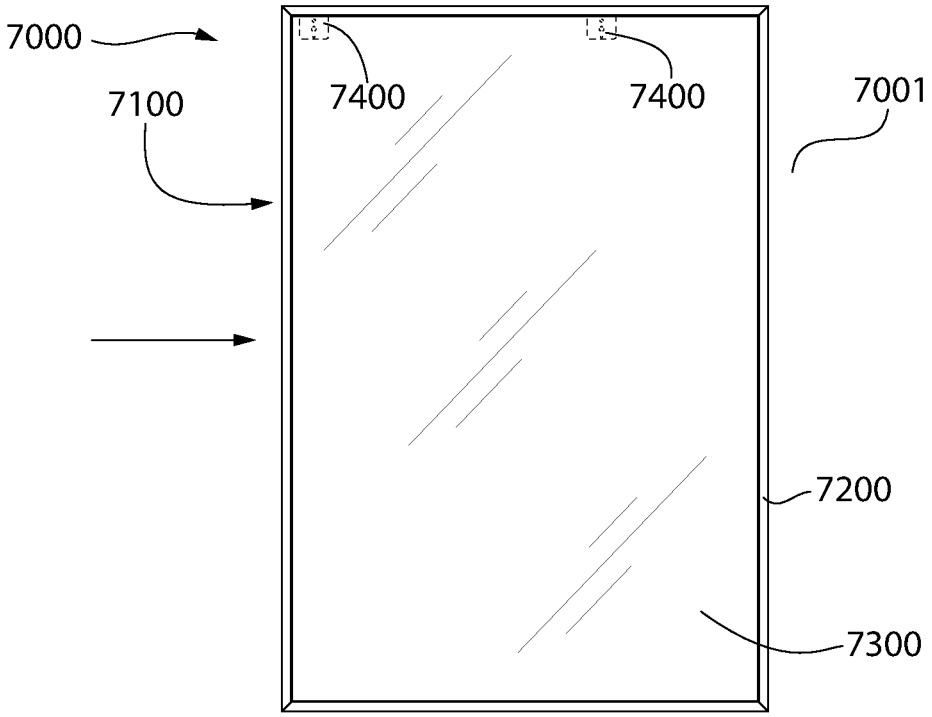

As shown in FIGS. 15A and 15B, two of the hanging brackets 7400 are coupled to the support surface 7001 at the same elevation but spaced apart in a horizontal direction. This enables the support structure 7200 to be coupled to both of the hanging brackets 7400 to ensure that the support structure 7200 is hung in a level manner. Furthermore, when two (or more) hanging brackets 7400 are used, the support structure 7200 may be translated/slid horizontally along the support surface 7001 while remaining coupled to the hanging brackets 7400 to change the specific location on the support surface 7001 at which the support structure 7200 is located without affecting the level hanging orientation of the support structure 7200. Of course, it is also possible that the support structure 7200 could be coupled to only one hanging bracket 7400 that is coupled to the support surface 7001 rather than two as shown. In such an embodiment, horizontally sliding the support structure 7200 will facilitate leveling the hanging orientation of the support structure 7200 rather than sliding the support structure 7200 horizontally along the support surface 7001 while maintaining its level hanging orientation.

Thus, when the support structure 7200 (or hanging apparatus 7100) is coupled to the hanging bracket 7400 in the manner described above while the hanging bracket 7400 is coupled to the support surface 7001, the support structure 7200 (and also any article 7300 coupled to the support structure 7200) can be slid side-to-side (i.e., horizontally) along the support surface 7001 while the support structure 7200 stays coupled to the support surface 7001 via the hanging bracket 7400. This side-to-side movement of the support structure 7200 is illustrated in FIGS. 15A and 15B. As can be seen, the location of the hanging bracket 7400 relative to the support surface 7001 does not change. However, the location of the hanging bracket 7400 relative to the support structure 7200, and more specifically relative to the mounting groove 7250 of the support structure 7200, does change as the support structure 7200 slides along the support surface 7001. Similarly, the location of the support structure 7200 (and more specifically the hanging apparatus 7100) is also changed as the support structure 7200 is moved side-to-side along the support structure 7200.

Figure 16:
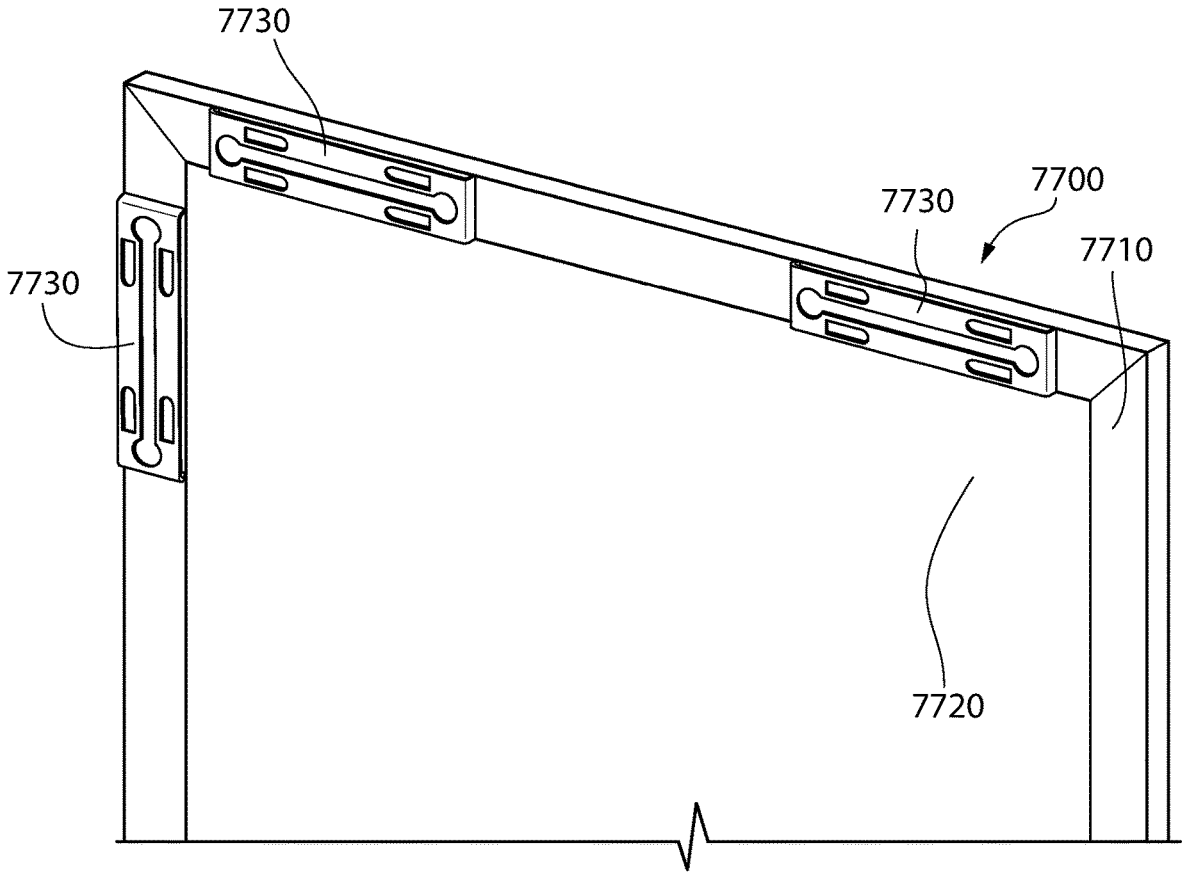
FIG. 16 is a rear perspective view of a hanging system including a support structure and a plurality of hanging brackets in accordance with another embodiment of the present invention.
Figure 17:
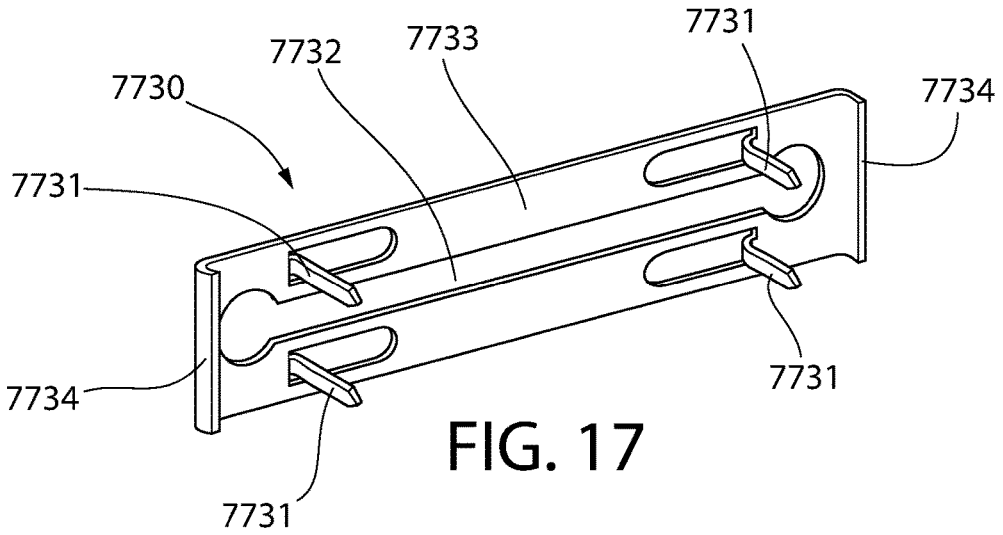
FIG. 17 is a perspective view of one of the hanging brackets of FIG. 16.

FIGS. 16 and 17 illustrates yet another alternative embodiment of a hanging system 7700 comprising a support structure 7710, an article 7720 supported by the support structure 7710, and a hanging bracket 7730 for hanging the support structure 7710 from a support surface such as a wall. In this embodiment, the hanging bracket 7730 (or a plurality of the hanging brackets 7730) are coupled to the support structure 7710 first, and then hung from a fastener protruding from the support surface. In this embodiment, the support structure 7710 does not need a mounting channel because the hanging brackets 7730 are coupled directly to the support structure 7700 via mechanical interlock, adhesive, external hardware such as screws or nails, or the like.

In the exemplified embodiment, the hanging brackets 7730 have prongs (or barbs or the like) 7231 that facilitate the coupling of the hanging brackets 7730 to the support structure 7710 (rather than for the coupling of the hanging brackets 7730 to the support surface (i.e., wall). In the exemplified embodiment, the support structure 7710 has a planar rear surface rather than having a mounting channel formed therein, and the hanging brackets 7730 are coupled to the planar rear surface of the support structure 7700. The support structure 7700 in such an embodiment may be sold with the hanging brackets 7730 already coupled thereto, or the hanging brackets 7730 could be later coupled to the support structure 7700 by a consumer prior to mounting the support structure 7700 to a support surface such as a wall.

The hanging brackets 7730 comprise an elongated mounting slot 7732 that is designed to receive a screw or other piece of hardware that is protruding from a support surface such as a wall. Specifically, when the hanging brackets 7730 are coupled to the support structure 7200, a main body 7733 of the hanging brackets 7730 are spaced apart from the rear surface of the support structure 7200 due to the hanging brackets 7730 having flanges 7734 extending from the opposing ends of the main body 7733. When coupled to the support structure 7700, the prongs 7731 of the hanging brackets 7730 extend into the support structure 7700 and the flanges 7734 contact the rear surface of the support structure 7700 to maintain a space between the main body 7733 of the hanging brackets 7730 and the rear surface of the support structure 7700. Thus, the head of a screw, nail, or similar piece of hardware that is protruding from a wall can be placed into the elongated mounting slots 7732 of the hanging brackets 7730 to mount the support structure 7700 to a support surface such as a wall. Because the mounting slots 7732 are elongated, the support structure 7700 can be slid side-to-side along the wall while the head of the screw or the like slides within the elongated mounting slots 7732 to enable the support structure 7700 to be relocated along the support surface/wall without having to remove the head of the screw from the elongated mounting slot 7732. Thus, this embodiment allows for the same type of side-to-side movement of the support structure 7200 as has been described above utilizing a different style of hanging bracket.

Referring to FIGS. 19-26 relate to an embodiment of the invention that is, in some regards, distinct from the embodiment(s) described above with regard to FIGS. 1-17. Specifically, FIGS. 19-26 illustrate a hanging system 8000 comprising a hanging apparatus 8100 and one or more reinforcement brackets 8400. The hanging apparatus 8100 comprises a support structure 8200 and an article 8300 supported by the support structure 8200 Unless otherwise stated herein, the hanging apparatus 8100 is identical to the hanging apparatus 7100 described above. Thus, in the interest of brevity, the hanging apparatus 8100, and more specifically the support structure 8200 thereof, may not be described in great detail. However, it should be appreciated that the description of the support structure 7200 provided above is completely applicable to the structure, configuration, and the like of the support structure 8200. Features of the hanging apparatus 8100 that are identical to the hanging apparatus 7100 will be similarly numbered except that the 8000 series of numbers will be used instead of the 7000 series of numbers. Some features of the hanging apparatus 8100 may be numbered but not described, in which case it should be appreciated that the description of the same feature of the hanging apparatus 7100 is applicable.

Figure 18A:
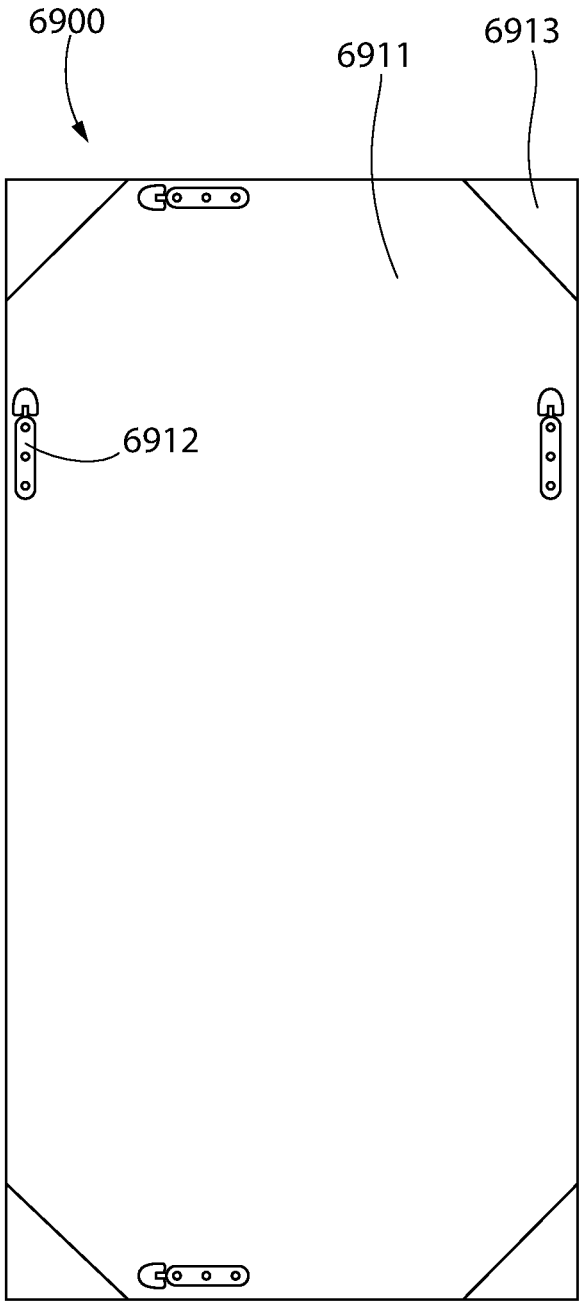
FIG. 18A (PRIOR ART)
FIGS. 18A and 18B illustrate a prior art hanging system.
Figure 18B:
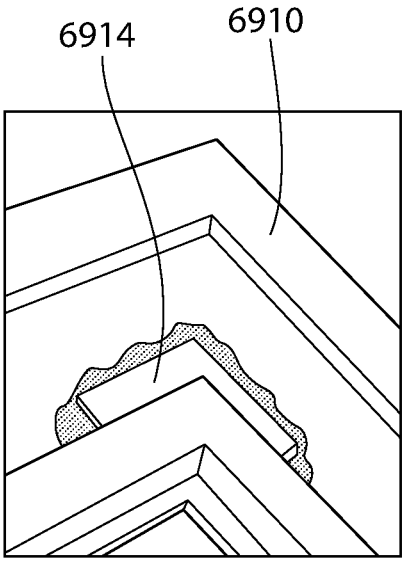
FIG. 18B (PRIOR ART)

Before describing the hanging system 8000, a prior art hanging system 6900 will be described with reference to FIGS. 18A and 18B. The hanging system 6900 comprises a support structure 6910 that is intended to support a mirror. Typical hanging systems 6900 of this type include a dust cover 6911 covering the rear surface of the support structure 6910, four multiple screw D-ring hangers 6912 coupled to the rear surface of the support structure 6910 atop the dust cover 6911, four medium-density fiberboard (MDF) corner braces 6913 that are stapled to the rear surface of the support structure 6910 along each of the corners thereof, and between four and eight plastic corner supports 6914 that are glued to the support structure 6910 beneath the dust cover 6911. The dust cover 6911, MDF corner braces 6913, and corner supports 6914 are required in order to provide the support structure 6910 with sufficient strength to support the mirror (which can be heavy). The D-ring hangers 6912 are needed to enable the support structure 6910 to be hung from a support surface. The invention described herein below with reference to FIGS. 19-26 replaces all of the D-ring hangers 6912, the MDF corner braces 6913, and the corner supports 6914 with four reinforcement brackets that serve the dual purpose of maintaining the structural competency of the support structure and facilitating the hanging of the support structure from a support surface such as a wall. Thus, the invention described herein below significantly reduces the variation and amount of materials required to make a hanging system.

Figure 19:
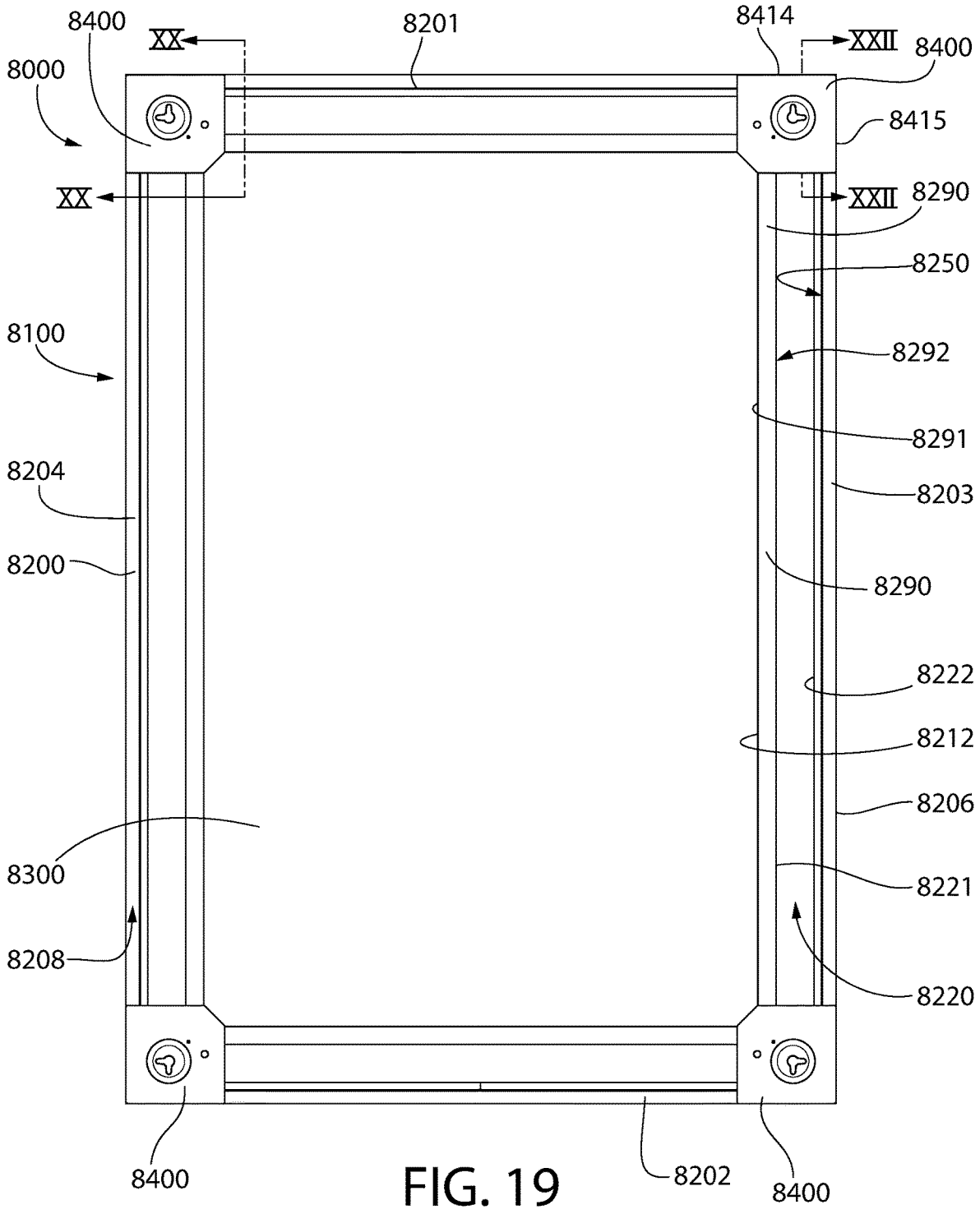
FIG. 19 is a rear view of a hanging system including a support structure and a plurality of reinforcement brackets in accordance with an embodiment of the present invention.

Referring to FIG. 19, a hanging system 8000 is illustrated in accordance with an embodiment of the present invention. FIG. 19 is a rear view of the hanging system 8000, and the front view is identical to that which is depicted in FIG. 1 and thus the description of FIG. 1 is applicable to the hanging system 8000 as well. As mentioned above, the hanging system 8000 generally comprises a support structure 8200 and at least one reinforcement bracket 8400 coupled to the support structure 8200. In the exemplified embodiment, there are four of the reinforcement brackets 8400 coupled to the support structure 8200, one on each corner of the support structure 8200. However, in other embodiments there may be only two of the reinforcement brackets 8400 coupled to the support structure 8200 on adjacent corners of the support structure 8200. Because the reinforcement brackets 8400 are coupled to the support structure 8200 at the corners thereof, the reinforcement brackets 8400 may be understood to be corner brackets, corner supports, or similar. In addition to performing a reinforcement function, the reinforcement brackets 8400 are also used as the components of the hanging system 8000 that facilitate hanging the support structure 8200 from a support surface, such as a wall. Thus, the use of the reinforcement brackets 8400 replaces several conventional components in a single, monolithic structure.

In the exemplified embodiment, the support structure 8200 supports an article 8300 that is intended to be framed by the support structure 8200. In the exemplified embodiment, the article 8300 is a mirror. However, the invention is not to be so limited in all embodiments and the article 8300 could be any other item typically displayed in a frame, such as a photograph, a drawing, an illustration, a canvas, a work of art, or the like. Thus, the invention is not intended to be particularly limited by the specific type of article that is supported by the hanging system 8000 unless specifically claimed as such.

Figure 20:
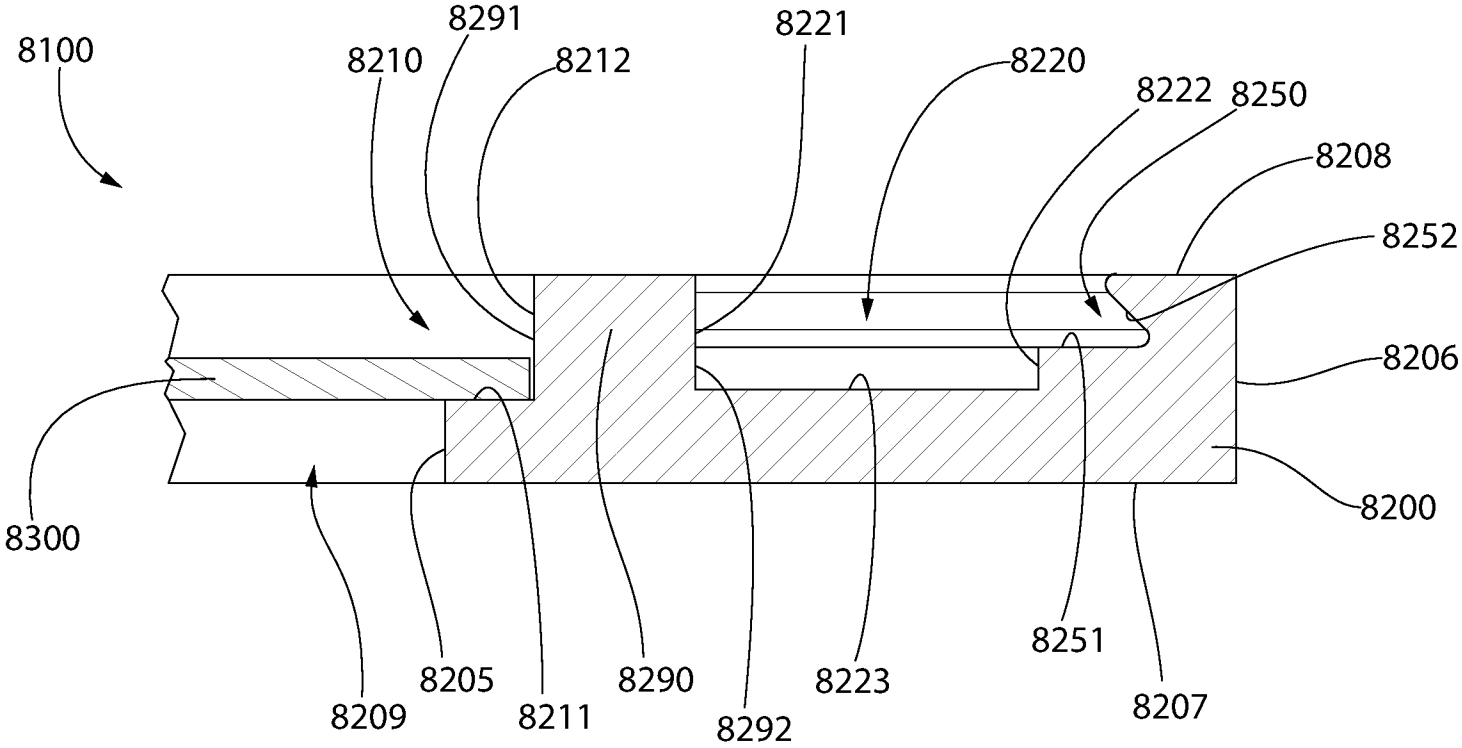
FIG. 20 is a cross-sectional view taken along line XX-XX of FIG. 19.
Figure 21B:
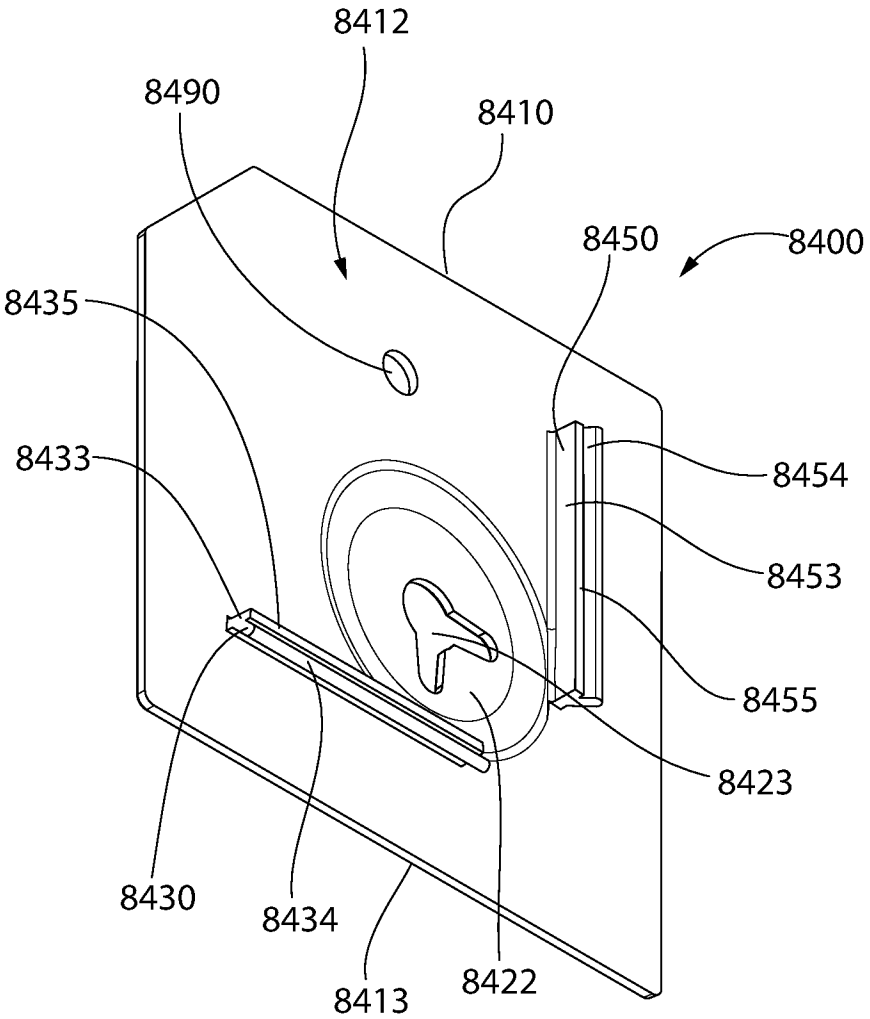
FIGS. 21A-21E are front perspective, rear perspective, front, rear, and side views, respectively, of one of the reinforcement brackets of FIG. 19.
Figure 21A:
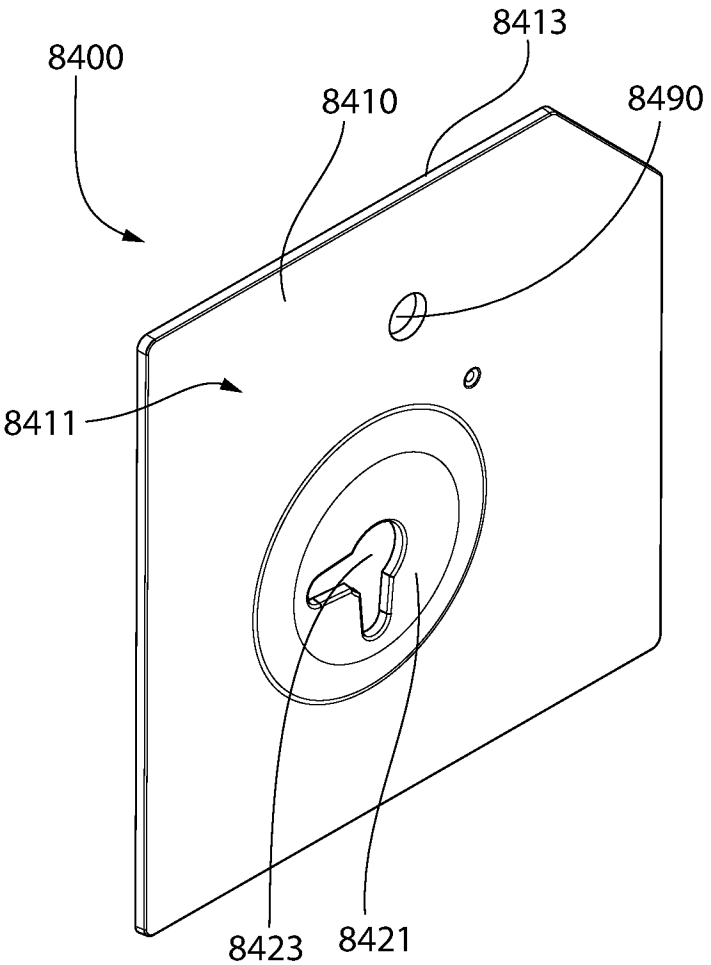
Figure 21D:
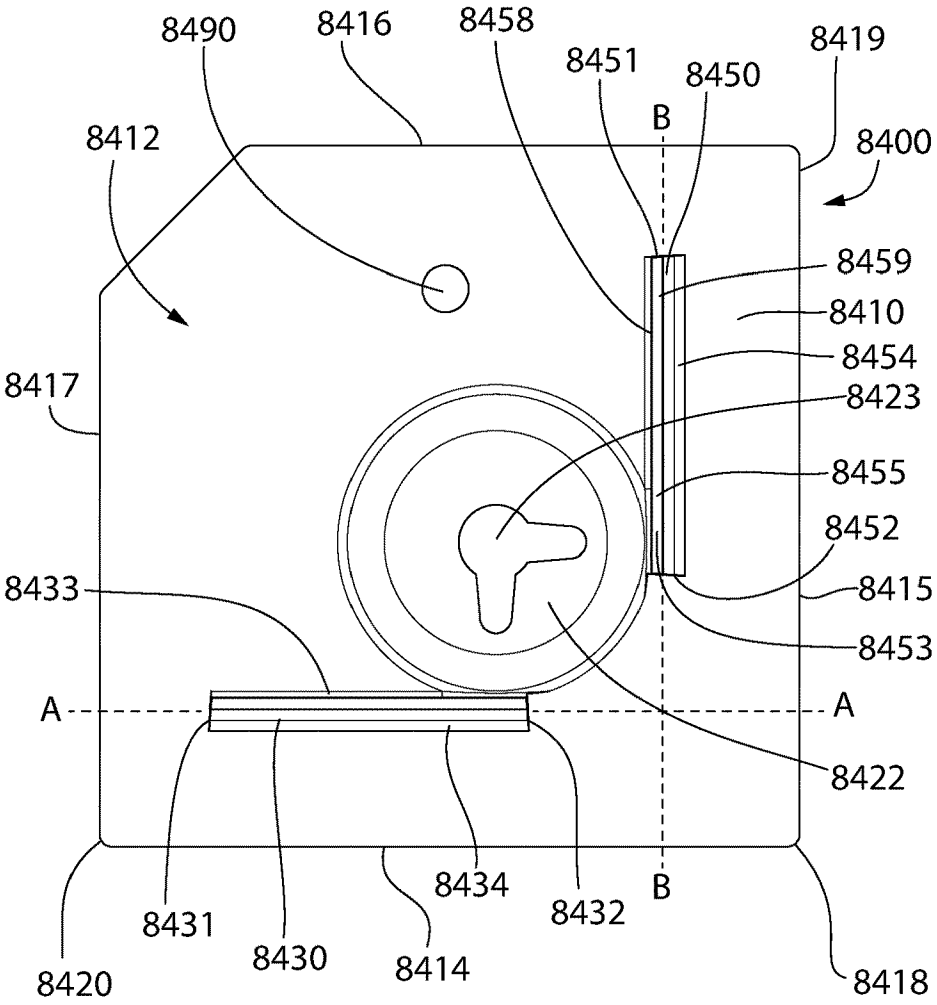
Figure 21C:
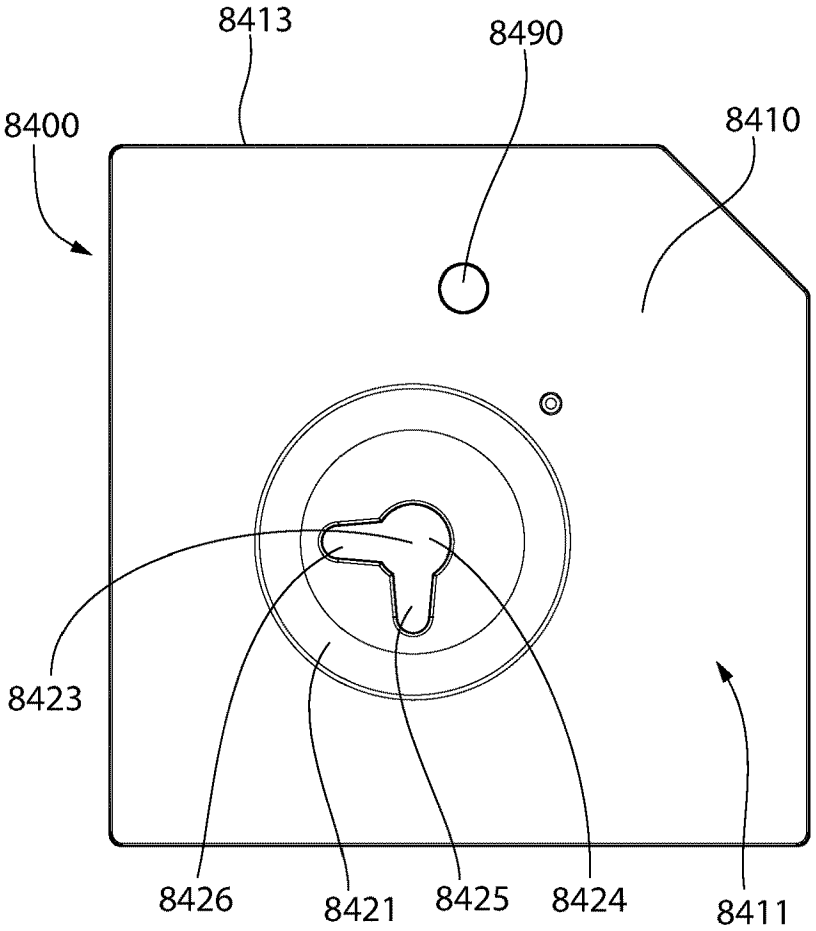
Figure 21E:
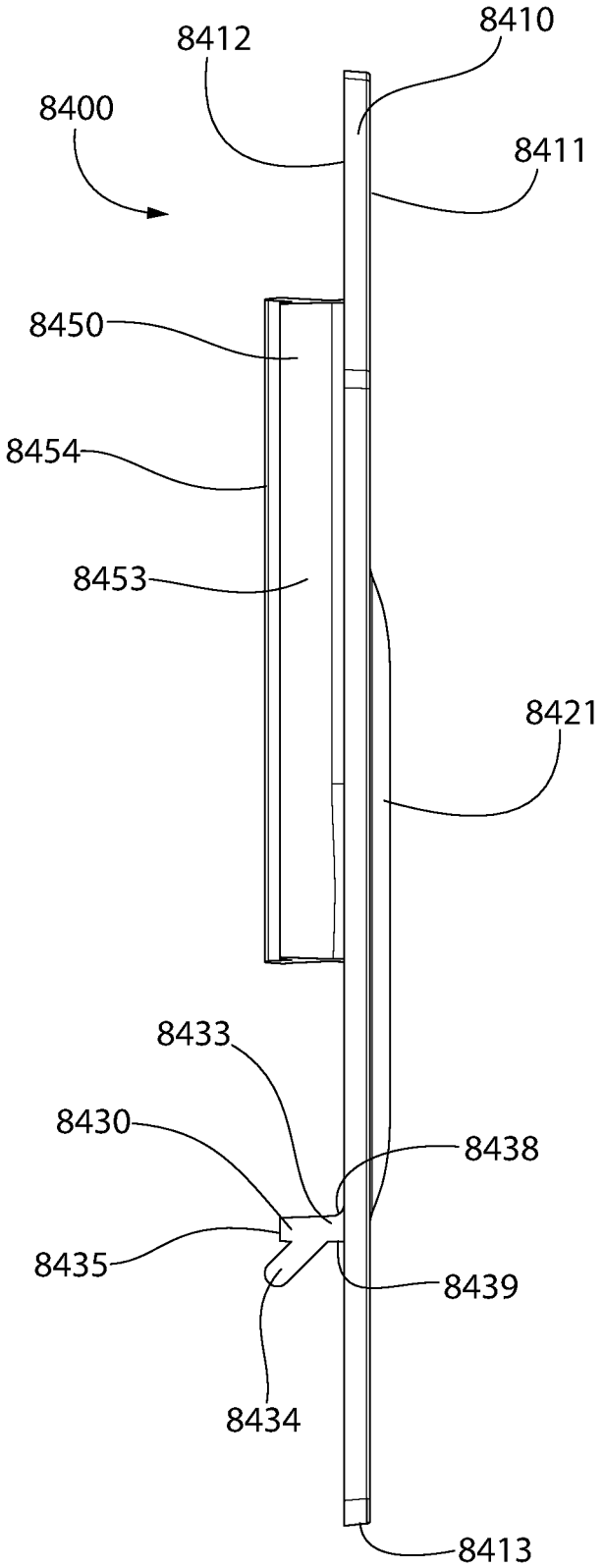

Referring to FIGS. 19 and 20, the support structure 8200 will be described in greater detail. As mentioned above, the support structure 8200 is identical to the support structure 7200 previously described and therefore the description of the support structure 7200 above can be referenced for additional details. Moreover, some additional details may be provided below for the support structure 8200 that were not provided above for the support structure 7200. In such instances, the description of the support structure 8200 is applicable to the support structure 7200.

The support structure 8200 comprises a plurality of sections including a top section 8201, a bottom section 8202, a first side section 8203, and a second side section 8204 that are coupled together to form the support structure 8200. In the exemplified embodiment, each of the sections 8201-8204 of the support structure 8200 are linear sections having mitered ends so that each of the top and bottom section 8201, 8202 can be joined to the side sections 8203, 8204 at the mitered ends. The linear sections with mitered ends may be joined together by placing the mitered ends into contact with one another and then using fasteners (i.e., staples or the like) to couple the linear sections together. Additionally, an adhesive may be used to assist in the coupling of the two linear sections together. Corners of the support structure 8200 are formed at the location where the mitered ends of the sections 8201-8204 meet. The sections 8201-8204 may be coupled together using fasteners, adhesive, or the like in various embodiments. Furthermore, the reinforcement brackets 8400 also assist in securing the sections 8201-8204 to one another, as described more fully below.

The support structure 8200 comprises an inner surface 8205, an outer surface 8206, a front surface 8207, and a rear surface 8208. When the support structure 8200 is displayed (i.e., hung on a wall, leaning against a wall, or otherwise positioned in its desired location), the rear surface 8208 is the portion of the support structure 8200 that abuts against a wall or other support surface and the front surface 8207 is the portion of the support structure 8200 that is exposed. The inner surface 8205 of the support structure 8200 defines a display opening 8209 through which the article 8300 can be viewed.

The support structure 8200 comprises a rabbet 8210 configured to support the article 8300 and a channel 8220 that is distinct from the rabbet 8210. The rabbet 8210 is defined by a floor 8211 and a wall 8212. The article 8300 is supported within the display opening 8209 by the floor 8211 of the rabbet 8210 and the article 8300 is surrounded by the wall 8212. The floor 8211 of the rabbet 8210 and/or the wall 8212 of the rabbet 8210 may be a continuous surface or a discontinuous surface in various embodiments. The channel 8220 is located between the rabbet 8210 and the outer surface 8206 of the support structure 8200. The channel 8220 is defined by an inner wall 8221, an outer wall 8222, and a floor 8223. Both the rabbet 8210 and the channel 8220 are open at the rear surface 8208 of the support structure 8200. Thus, in the exemplified embodiment the support structure 8200 is a rear-loaded frame, meaning the article 8300 is loaded into the rabbet 8210 from the rear surface 8208 of the support structure 8200. The article 8300 may be adhered to the support structure 8200 by placing adhesive/glue on the floor 8211 of the rabbet 8210 and/or the support structure 8200 may include retaining elements/tabs that protrude from the wall 8212 of the rabbet 8210 to retain the article 8300 within the rabbet 8210.

In the exemplified embodiment, the support structure 8200 includes an upstanding wall 8290 located between the rabbet 8210 and the channel 8220. The upstanding wall 8290 has an inner surface 8291 and an outer surface 8292. The inner surface 8291 of the upstanding wall 8290 faces the rabbet 8210 and therefore forms the wall 8212 of the rabbet 8210 and the outer surface 8292 of the upstanding wall 8290 faces the channel 8220 and therefore forms the inner wall 8221 of the channel 8220. Thus, the upstanding wall 8290 separates the rabbet 8210 from the channel 8220. In the exemplified embodiment, the outer surface 8291 of the upstanding wall 8290, and hence also the inner wall 8212 of the channel 8220, is a smooth, continuous vertical surface/wall that extends perpendicularly from the floor 8223 of the channel 8220 to the rear surface 8208 of the support structure 8200. Thus, in the exemplified embodiment the inner wall 8221 of the channel 8220 does not have any grooves, cutouts, flanges, lips, protrusions, or the like to facilitate coupling of the reinforcement brackets 8400 to the support structure 8200.

In the exemplified embodiment, the channel 8220 is a continuous annular channel that surrounds the rabbet 8210. The term "annular" is not intended to be limited to round or ring-like shapes, but may include any closed geometric shape including square, rectangular, triangular, pentagonal, and the like. The channel 8220 need not be continuous and annular in all embodiments and may instead comprise spaced apart channel segments. In some embodiments, the channel 8220 should be located at least along the corners of the support structure 8200 to facilitate mounting of the reinforcement brackets 8400 to the support structure 8200 along the corners of the support structure 8200.

The support structure 8200 also includes a mounting groove 8250 formed into the outer wall 8222 of the channel 8220. In the exemplified embodiment, the mounting groove 8250 is defined by a floor 8251 and a mounting surface 8252 that extends from the floor 8251 to the rear surface 8208 of the support structure 8200. In the exemplified embodiment, the floor 8251 of the mounting groove 8250 is elevated relative to the floor 8223 of the channel 8220 in the, but this is not required in all embodiments and the floor 8251 of the mounting groove 8250 and the floor 8223 of the channel 8220 may form a continuous, smooth, planar surface in some embodiments (see, for example, the mounting channel profile provided in FIGS. 8A and 8B, described above). Furthermore, although the mounting groove 8250 is described herein as being formed into the outer wall 8222 of the channel 8220, in other embodiments the mounting groove 8250 may form a part of the channel 8220 such that the mounting surface 8252 of the mounting groove 8250 forms an outer wall of the channel 8220.

The mounting surface 8252 extends from the floor 8251 of the mounting groove 8250 to the rear surface 8208 of the support structure 8200. In the exemplified embodiment, the mounting surface 8252 is oriented at an oblique angle relative to the floor 8251 and relative to the rear surface 8208. More specifically, the mounting surface 8252 is oriented at an acute angle relative to the floor 8251 as it extends from the floor 8251 to the rear surface 8208 of the support structure 8200. Of course, the invention is not to be limited by the structure depicted in the drawings in all embodiments. In alternative embodiments, the mounting surface 8252 may extend perpendicularly from the floor 8251. In still other embodiments, the mounting surface 8252 may include a vertical portion extending from the floor 8251 and a horizontal portion extending from the vertical portion. Basically, the mounting groove 8250 may have any structure so long as it includes an engagement surface that is configured to interact/engage with a mounting element on the reinforcement bracket 8400 to couple the reinforcement bracket 8400 to the support structure 8200, as described in detail below. In the exemplified embodiment, the mounting surface 8252 is the engagement surface, but the mounting surface 8252 may be oriented at angles different than that which is shown in the drawings and may also be formed from multiple walls in other embodiments. Thus, variations in the exact structure of the mounting groove 8250 are possible without affecting its function.

Referring to FIGS. 21A-21E, the reinforcement bracket 8400 will be described. The reinforcement bracket 8400 may be formed of a hard-plastic material in an injection molding process. Specifically, in one embodiment the bracket 200 may be formed from high impact polystyrene. In another embodiment, the reinforcement bracket 8400 may be formed from acrylonitrile butadiene styrene ("ABS"), polypropylene, or other hard plastics. Of course, the reinforcement bracket 8400 may be formed using other techniques, including without limitation, extrusion, emulsion, continuous mass polymerization, or the like in other embodiments. Furthermore, the reinforcement bracket 8400 can be formed of other materials in other embodiments, including metal or the like.

The reinforcement bracket 8400 comprises a plate 8410 having a front surface 8411 and a rear surface 8412 opposite the front surface 8411. The front and rear surfaces 8411, 8412 of the plate 8410 form the major surfaces of the plate 8410. The plate 8410 also includes an edge 8413 that extends between the front and rear surfaces 8411, 8412. In the exemplified embodiment, the edge 8413 comprises a first portion 8414, a second portion 8415, a third portion 8416 opposite the first portion 8414, and a fourth portion 8417 opposite the second portion 8415. The first and second portions 8414, 8415 meet a first corner 8418 of the plate 8410, the second and third portions 8415, 8416 meet at a second corner 8419 of the plate 8410, and the first and fourth portions 8414, 8417 meet at a third corner 8420 of the plate 8410. In the exemplified embodiment, the plate 8410 has the shape of square or rectangle with one truncated or clipped corner (i.e., the corner that would otherwise exist at the intersection of the third and fourth portions 8416, 8417 of the edge 8413). Thus, the edge 8413 comprises a plurality of edge portions, each of which forms a distinct linear section of the edge 8413. However, the invention is not to be so limited in all embodiments and the plate 8410 may take on other shapes without affecting its function as described herein.

In the exemplified embodiment, the front surface 8411 of the plate 8410 comprises a raised portion 8421, which is a portion of the front surface 8411 that is elevated relative to a remainder of the front surface 8411. In the exemplified embodiment, the raised portion 8421 is surrounded by the remainder of the front surface 8411, also referred to herein as the non-raised portion of the front surface 8411. The non-raised portion may be planar and the raised portion 8421 may also be planar, but elevated relative to the non-raised portion. In the exemplified embodiment, a depression 8422 is located in the rear surface 8412 at a location that corresponds with the location of the raised portion 8421 on the front surface 8411. However, the raised portion 8421 could exist without the depression 8422 in alternative embodiments with the use of additional material. The raised portion 8421 is illustrated in the drawings as being circular in shape, but the raised portion 8421 may have other shapes in other embodiments. Furthermore, the raised portion 8421 need not be included in all embodiments and in some alternative embodiments the entirety of the front surface 8411 of the plate 8410 may be at the same elevation.

The reinforcement bracket 8400 comprises an aperture 8423 extending from the front surface 8411 to the rear surface 8412. In the exemplified embodiment, the aperture 8423 is located within the raised portion 8421 of the front surface 8411, but this is not required in all embodiments. The aperture 8423 is configured to receive a portion of a piece of hardware (i.e., a screw head, a nail head, or the like) to support the hanging system 8000 from a wall or other support surface. In the exemplified embodiment, the aperture 8423 has a partial-cruciform shape, which enables the aperture 8423 to receive the desired hardware regardless of the orientation of the reinforcement bracket 8400. In other embodiments, the apertures 8423 may have a full cruciform shape. Thus, the same reinforcement bracket 8400 can be coupled to each of the corners of the support structure 8200 and used to hang the hanging system 8000. However, the aperture 8421 need not be cruciform shaped in all embodiments and may be linear or have various other shapes in alternative embodiments.

In the exemplified embodiment, the apertures 8423 comprises a central portion 8424, a first leg portion 8425 extending from the central portion 8424, and a second leg portion 8426 extending from the central portion 8424. In the exemplified embodiment, the central portion 8424 is circular-shaped and the first and second leg portions 8425, 8426 are elongated away from the central portion 8424. The first and second leg portions 8425, 8426 are circumferentially spaced apart from one another by approximately 45°. The central portion 8424 has a greater cross-sectional area than each of the first and second leg portions 8425, 8426. Thus, during use the central portion 8424 receives a head of a fastener (i.e., a screw) and then the support structure 8200 is moved downwardly so that a neck portion of the fastener nests within one of the first and second leg portions 8425, 8426.

The reinforcement bracket 8400 comprises a hole 8490 extending through the reinforcement bracket 8400 from the front surface 8411 to the rear surface 8412. The hole 8490 is used for securing the support structure 8200 to a support surface (such as a well) when the support structure 8200 rests atop a floor or ground surface and is made to lean against the support surface (rather than mounting the support structure 8200 to the support surface). Specifically, sometimes user's simply rest mirrors on the ground and lean them against a wall for their use position. This is generally done with mirrors in a bathroom or other location where a user might want to view his/her entire body in the mirror from head to toe. Thus, the hole 8490 allows a user to use this leaning position while also securing the support structure 8200 to the support surface for safety.

The reinforcement bracket 8400 also comprises a first mounting element 8430 and a second mounting element 8450 extending from the rear surface 8412. The first and second mounting elements 8430, 8450 are separate and spaced apart from one another. In the exemplified embodiment, each of the first and second mounting elements 8430, 8450 are elongated mounting features that facilitate coupling of the reinforcement bracket 8400 to the support structure 8200, as described in greater detail below. The first mounting element 8430 extends from a first end 8431 to a second end 8432 along a first axis A-A and the second mounting element 8450 extends from a first end 8451 to a second end 8452 along a second axis B-B. In the exemplified embodiment, the first and second axes A-A, B-B are oriented perpendicular to one another. Of course, the first and second mounting elements 8430, 8450 need not be elongated in all embodiments. Furthermore, each of the first and second mounting elements 8430, 8450 may comprise a plurality of spaced apart mounting sections that collectively form the mounting elements 8430, 8450. Thus, variations are possible and would fall within the scope of the claimed invention.

The first mounting element 8430 extends adjacent to (but spaced apart from) the first portion 8414 of the edge 8413 in a direction parallel to the first portion 8414 of the edge 8413. The second mounting element 8450 extends adjacent to (but spaced apart from) the second portion 8415 of the edge 8413 in a direction parallel to the second portion 8415 of the edge 8413. The first end 8451 of the first mounting element 8430 is positioned closer to the fourth portion 8417 of the edge 8413 than the second end 8452 of the first mounting element 8430 is to the second portion 8415 of the edge 8413. The first end 8451 of the second mounting element 8450 is positioned closer to the third portion 8416 of the edge 8413 than the second portion 8452 of the second mounting element 8450 is to the first portion 8414 of the edge 8413. Of course, the first mounting element 8430 may be moved in the direction of its axis A-A to be positioned at a different location and the second mounting element 8450 may be moved in the direction of its axis B-B to be positioned at a different location in other embodiments without affecting the function of the first and second mounting elements 8430, 8450 (i.e., without affecting the ability of the first and second mounting elements 8430, 8450 to interact with/engage the mounting groove 8250 to couple the first and second mounting element 8430, 8450 to the support structure 8200).

In the exemplified embodiment, the first mounting element 8430 comprises a first portion 8433 that extends from the rear surface 8412 of the plate 8410 to a distal end 8435 and a second portion 8434 that extends from the first portion 8433. The first portion 8433 comprises a first surface 8439 that faces the first edge 8414 and a second surface 8438 opposite the first surface 8439. The second portion 8434 extends from the first surface 8438 of the first portion 8433. Specifically, the first portion 8433 may extend perpendicularly from the rear surface 8412 of the plate 8410 to the distal end 8435. Furthermore, the second portion 8434 may extend from the first portion 8433 at an oblique angle relative to the first portion 8433. In the exemplified embodiment, the second portion 8434 extends from the first portion 8433 at an obtuse angle. Moreover, in the exemplified embodiment the second portion 8434 extends from the first portion 8433 at a location between the rear surface 8412 of the plate 8410 and the distal end 8435 of the first portion 8433. However, in other embodiments the second portion 8434 may extend from the distal end 8435 of the first portion 8433.

Moreover, although in the exemplified embodiment the second portion 8434 extends obliquely from the first portion 8433, in other embodiments the second portion 8434 may extend perpendicularly from the first portion 8433. In still other embodiments, the second portion 8434 may extend obliquely directly from the rear surface 8412 of the plate 8410 (and thus the first portion 8433 may be omitted). The exact structure of the first mounting element 8430 will be dictated, at least in part, based on the structure of the mounting groove 8250 of the support structure 8200 because the first mounting element 8430, or a portion thereof, nests within the mounting groove 8250 when the reinforcement bracket 8400 is coupled to the support structure 8200. Thus, if the mounting groove 8250 of the support structure 8200 is modified, so too will the first mounting element 8430 be modified in a corresponding fashion.

In the exemplified embodiment, the second mounting element 8450 comprises a first portion 8453 that extends from the rear surface 8412 of the plate 8410 to a distal end 8355 and a second portion 8454 that extends from the first portion 8453. The first portion 8453 comprises a first surface 8459 that faces the second edge 8415 and a second surface 8458 opposite the first surface 8459. The second portion 8454 extends from the first surface 8458 of the first portion 8453. Specifically, the first portion 8453 may extend perpendicularly from the rear surface 8412 of the plate 8410 to the distal end 8455. Furthermore, the second portion 8454 may extend from the first portion 8453 at an oblique angle relative to the first portion 8453. In the exemplified embodiment, the second portion 8454 extends from the first portion 8453 at an obtuse angle. Moreover, in the exemplified embodiment the second portion 8454 extends from the first portion 8453 at a location between the rear surface 8412 of the plate 8410 and the distal end 8455 of the first portion

8453. However, in other embodiments the second portion 8454 may extend from the terminal end 8455 of the first portion 8453.

Moreover, although in the exemplified embodiment the second portion 8454 extends obliquely from the first portion 8453, in other embodiments the second portion 8454 may extend perpendicularly from the first portion 8453. In still other embodiments, the second portion 8454 may extend obliquely directly from the rear surface 8412 of the plate 8410 (and thus the first portion 8453 may be omitted). The exact structure of the second mounting element 8450 will be dictated, at least in part, based on the structure of the mounting groove 8250 of the support structure 8200 because the second mounting element 8450, or a portion thereof, nests within the mounting groove 8250 when the reinforcement bracket 8400 is coupled to the support structure 8200. Thus, if the mounting groove 8250 of the support structure 8200 is modified, so too will the second mounting element 8450 be modified in a corresponding fashion.

In the exemplified embodiment, the first mounting element 8430 is elongated in a direction parallel to the first portion 8414 of the edge 8413 of the plate 8410 and the second mounting element 8450 is elongated in a direction parallel to the second portion 8415 of the edge 8413 of the plate 8410. The first and second edge portions 8414, 8415 intersect at the first corner 8418 of the plate 8410. The first mounting element 8430 is located adjacent to, but spaced from, the first edge portion 8414. The second mounting element 8450 is located adjacent to, but spaced from, the second edge portion 8415.

Referring to FIG. 19, in the exemplified embodiment, when the reinforcement bracket 8400 is coupled to the support structure 8200, the first and second edge portions 8414, 8415 of the edge 8413 of the plate 8410 are flush with the outer surface 8206 of the support structure 8200. However, the invention is not to be so limited in all embodiments and the first and second edge portions 8414, 8415 of the edge 8413 of the plate 8410 could be set inwardly from the outer surface 8206 of the support structure 8200 in other embodiments. It is preferable that the edge 8413 of the plate 8410 not protrude beyond the outer surface 8206 of the support structure 8200 because this would create an undesirable aesthetic because it would make the plate 8410 at least partially visible from the front of the hanging system 8000.

When coupled to the support structure 8200, each of the reinforcement brackets 8400 overlies portions of two different sections of the support structure 8200. Thus, the reinforcement bracket 8400 in the upper left corner overlies a portion of the top section 8201 and a portion of the second side section 8204, the reinforcement bracket 8400 in the upper right corner overlies a portion of the top section 8201 and a portion of the first side portion 8203, the reinforcement bracket 8400 in the lower left corner overlies a portion of the bottom section 8202 and a portion of the second side section 8204, and the reinforcement bracket 8400 in the lower right corner overlies a portion of the bottom section 8202 and a portion of the first side section 8203. Furthermore, a portion of each of the reinforcement brackets 8200 that includes the truncated corner extends over the rabbet 8210. In this way, the reinforcement brackets 8200 may also serve a function of retaining the article 8300 within the rabbet 8210 of the support structure 8200. As will be discussed below, the reinforcement bracket 8400 may be coupled directly to each of the two sections of the support structure 8200 that it overlies, thereby serving a reinforcement function in the connection between the two sections of the support structure 8200.

Figure 22:
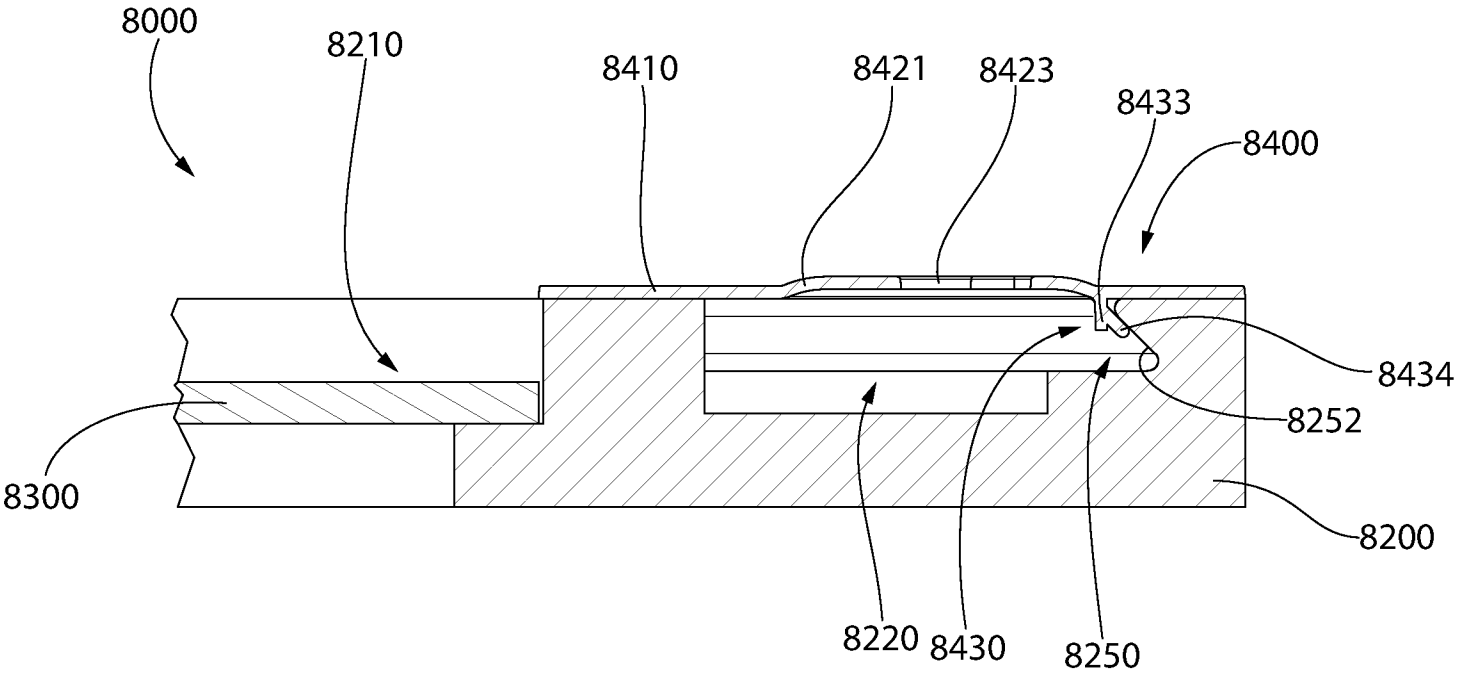
FIG. 22 is a cross-sectional view taken along line XXII-XXII of FIG. 19.

FIG. 22 is a cross-sectional view through the hanging system 1000, and more specifically through the support structure 8200 and one of the reinforcement brackets 8400. The reinforcement bracket 8400 is coupled to the support structure 8200 by inserting the first and second mounting elements 8430, 8450 of the reinforcement bracket 8400 into the mounting groove 8250 of the support structure 8200 so that the second portions, 8434, 8454 of the first and second mounting elements 8430, 8450 interact/mate/engage the mounting surface 8252 of the mounting groove 8250. In the exemplified embodiment, the orientation/inclination of the second portion 8434 of the first mounting element 8430 corresponds with/matches the orientation/inclination of the mounting surface 8252 (i.e., engagement surface) of the mounting groove 8250 (the same is true of the second portion 8453 of the second mounting element 8450, although this is not visible in the provided cross-sectional view). When the hanging system 8000 is in an upright orientation and hanging from a support surface such as a wall, gravity forces the mounting surface 8252 against the second portion 8434 of the first mounting element 8430 (or the second portion 8454 of the second mounting element 8450 depending on the orientation (portrait/vertical or landscape/horizontal) at which the hanging system 8000 is hung). When the reinforcement bracket 8400 is coupled to the support structure 8200, the aperture 8423 of the reinforcement bracket 8400 is aligned with the mounting channel 8220. This may assist in mounting the hanging system 8000 from a wall or other support surface using hardware (i.e., a nail, screw, or the like) and the aperture 8423 so that a portion of the hardware (i.e., the head of a screw) can extend through the aperture 8423 and into the channel 8220, described in more detail below with reference to FIGS. 7A and 7B.

Referring to FIGS. 23A-23E, the manner in which the reinforcement brackets 8400 are coupled to the support structure 8200 will be described. First, referring to FIGS. 23A and 23B, an adhesive 8050 is placed within the mounting groove 8250 at a location that is aligned with the location at which the first and second mounting elements 8430, 8450 will be positioned. More specifically, the adhesive 8050 is placed onto the mounting surface 8252 of the mounting groove 8250. Thus, in some embodiments, the adhesive 8050 does not extend across the entirety of the mounting groove 8250, but rather it is only placed at the locations at which it is needed (i.e., adjacent to the corners where the first and second mounting elements 8430, 8450 of the reinforcement brackets 8400 will engaged the mounting surface 8252 of the mounting groove 8250. Of course, the adhesive 8050 may be placed along the entirety of the mounting groove 8250 in other embodiments. Moreover, in other embodiments the adhesive 8050 may additionally or alternatively be positioned within the space 8051 (see FIG. 23C) between an engagement surface of the first mounting element 8430 and the rear surface 8412 of the plate 8410 of the reinforcement bracket 8400. The adhesive 8050 may be hot glue, wood glue, super glue, spray adhesives, epoxy, or the like in various different embodiments, although hot glue may be preferred in some embodiments.

Figure 23A:
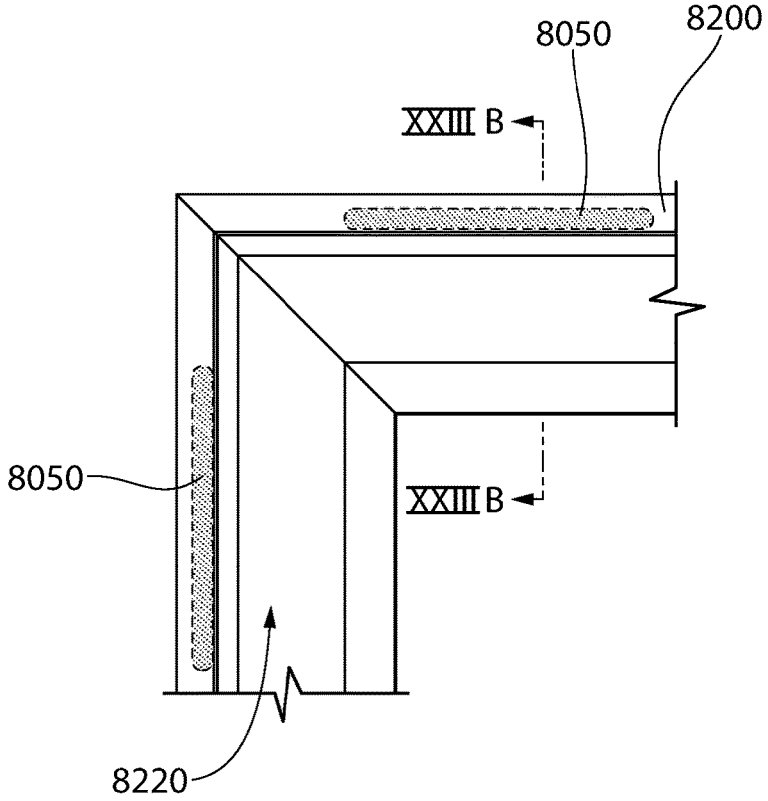
FIG. 23A is a rear view of a portion of the support structure of FIG. 19 illustrating an adhesive located within a mounting groove thereof.
Figure 23B:
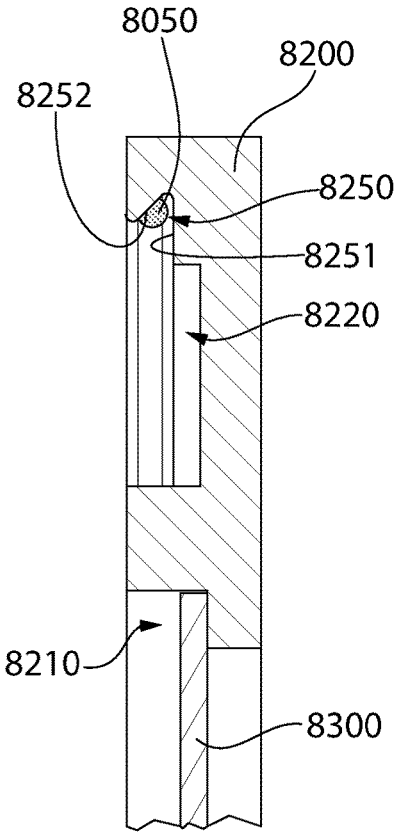
FIG. 23B is a cross-sectional view taken along line XXIIIB-XXIIIB of FIG. 23A.
Figure 23C:
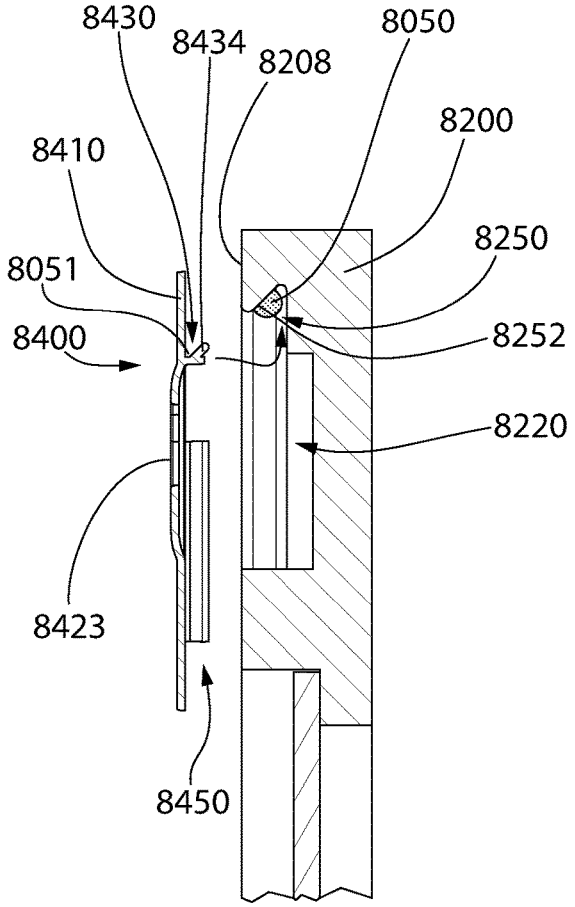
FIG. 23C is the cross-sectional view of FIG. 23B with one of the reinforcement brackets aligned with the mounting groove of the support structure.
Figure 23D:
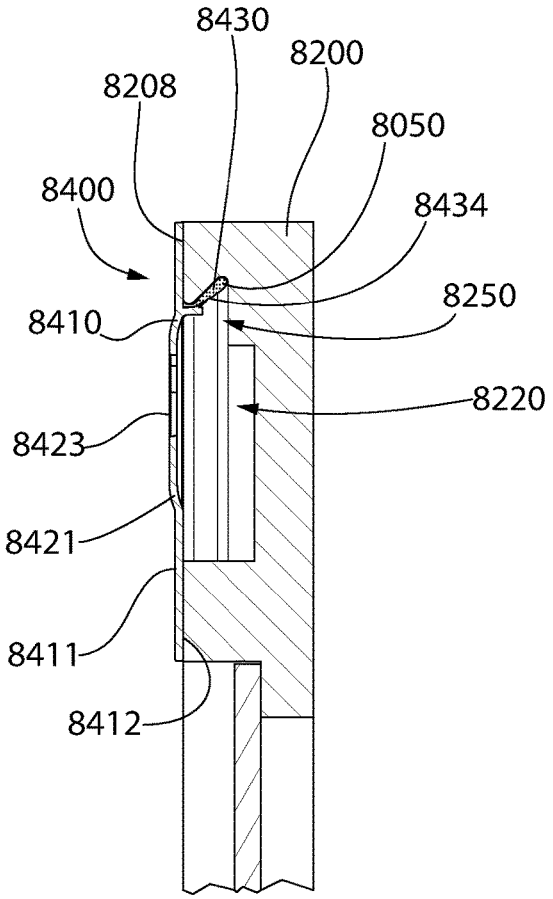
FIG. 23D is the cross-sectional view of FIG. 23C with one of the reinforcement brackets coupled to the support structure.
Figure 23E:
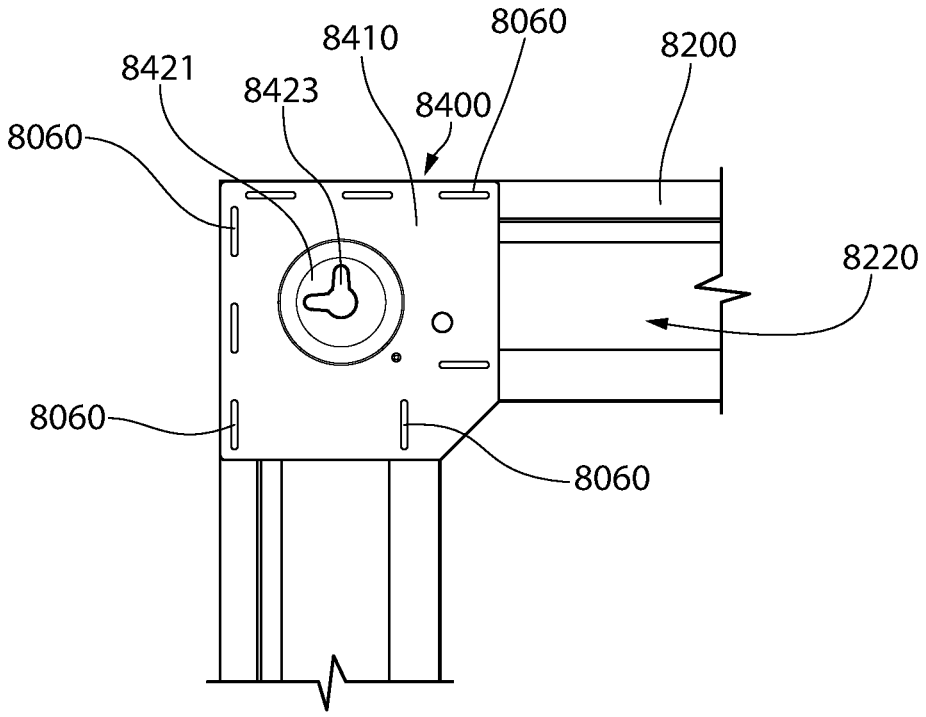
FIG. 23E is a rear view of the portion of the support structure of FIG. 23A with one of the reinforcement brackets coupled thereto.

Next referring to FIGS. 23C and 23D, the reinforcement bracket 8400 is aligned with the channel 8220 and move towards the rear surface 8208 of the support structure 8200 until the first and second mounting elements 8430, 8450 of the reinforcement bracket 8400 nest within the mounting groove 8250 of the support structure 8200. The first mounting elements 8430 will nest within a portion of the mounting groove 8250 formed by one of the sections 8201-8204 of the support structure 8200 and the second mounting element 8450 will nest within a portion of the mounting groove 8250 formed by an adjacent one of the sections 8201-8204 of the support structure 8200. As noted previously, the second portions 8434, 8454 of the first and second mounting elements 8430, 8450 engage the mounting surface 8252 of the mounting groove 8250 to mount/couple the reinforcement bracket 8400 to the support structure 8200. Furthermore, the adhesive 8050 adheres/locks the reinforcement bracket 8400 to the support structure 8200 so that the reinforcement bracket 8400 is fixed to the support structure 8200. Once the reinforcement bracket 8400 is coupled to the support structure 8200, the reinforcement bracket 8400 should be stationary/non-movable relative to the support structure 8200. As mentioned above, with the reinforcement bracket 8400 coupled to the support structure 8200, the aperture 8423 of the reinforcement bracket 8400 is aligned with the channel 8220. This provides a location between the support structure 8200 and the rear surface 8412 of the plate 8410 of the reinforcement bracket 8400 for a screw head or the like to be positioned when the hanging system 8000 is hanging from a wall or other support surface. However, because the aperture 8423 is located on the raised portion 8421 of the front surface 8411 of the plate 8410, the aperture 8423 need not be aligned with the channel 8220 in all embodiments.

Referring to FIG. 6E, once the reinforcement bracket 8400 is in place as noted above, a plurality of fasteners 8060 may be inserted through the reinforcement bracket 8400 and into the support structure 8200 to provide an additional layer of attachment between the reinforcement bracket 8400 and the support structure 8200. In the exemplified embodiment, the fasteners 8060 are staples. However, the fasteners 8060 can be any type of hardware as may be desired, such as screws, nails, bolts, or the like. Furthermore, the fasteners 8060 may be omitted in some embodiments if the adhesive 8050 is sufficient, by itself, to securely couple the reinforcement bracket 8400 to the support structure 8200. Alternatively, the adhesive 8050 may be omitted and the fasteners 8060 used by themselves to couple the reinforcement bracket 8400 to the support structure 8200 in other embodiments. In yet another alternative embodiment, the adhesive 8050 and the fasteners 8060 may both be omitted and the engagement between the mounting elements 8430, 8450 of the reinforcement bracket 8400 and the mounting groove 8250 of the support structure 8200 may be sufficient to couple the reinforcement bracket 8400 to the support structure 8200.

Figure 24A:
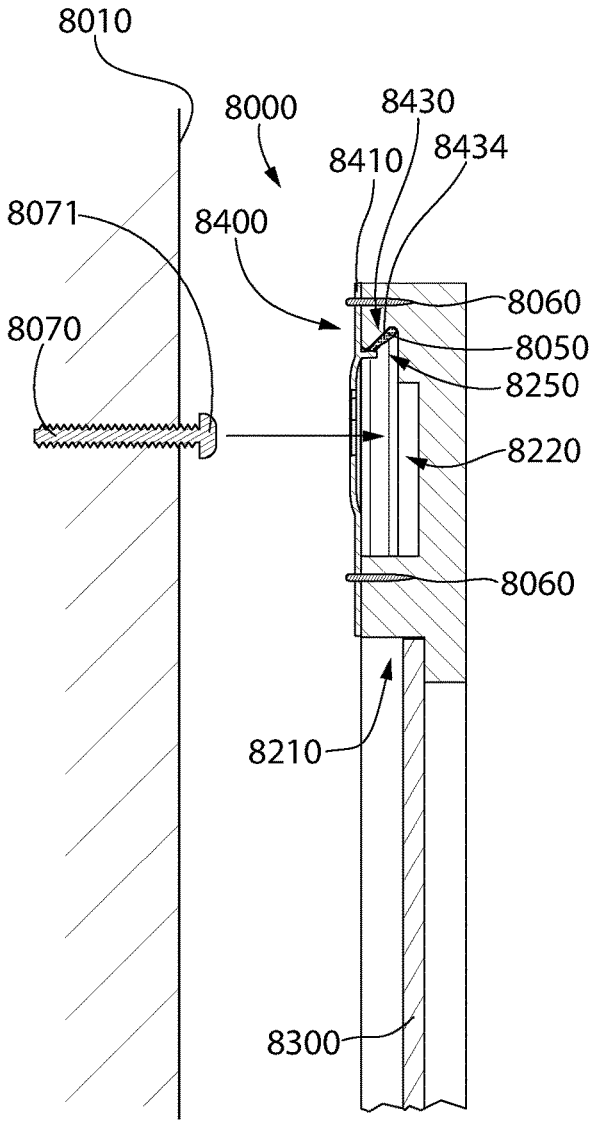

Referring to FIGS. 24A and 24B, the process of hanging the hanging system 8000 from a support surface 8010 such as a wall will be described. First, a fastener 8070 is coupled to the support surface 8010 so that a portion of the fastener 8070 is embedded in the support surface 8010 and another portion of the fastener 8070 protrudes from the support surface 8010. In the exemplified embodiment, the fastener 8070 is a screw and the portion that protrudes from the support surface 8010 includes a head 8071 of the screw. However, the invention is not to be so limited and the fastener 8070 can instead be a nail or any other piece of hardware or similar component that is capable of interacting with the aperture 8423 of the reinforcement bracket 8400 to mount the hanging system 8000 to the support surface 8010.

Next, the hanging system 8000 is moved towards the fastener 8070 until the portion of the fastener 8070 that protrudes from the support surface 8010 (i.e., the head 8071) enters into the aperture 8423 of the reinforcement bracket 8400. As best seen in FIG. 24B, because the aperture 8423 is aligned with the channel 8220, the head 8071 of the fastener 8070 enters into the channel 8220. In this manner, the hanging system 8000 is supported on the support surface 8010 via engagement between the fastener 8070 and the reinforcement bracket 8400. The reinforcement bracket 8400 is securely coupled to the support structure 8200 as described above and thus the entire hanging system 8000 is thereby mounted to the support surface 8010. Preferably, two of the reinforcement brackets 8400 are coupled to fasteners that are spaced apart along the support surface 8010, although it is possible that up to all four of the reinforcement brackets 8400 may be separately coupled to different fasteners on the support surface 8010 to provide additional mounting support depending on the weight of the hanging system 8000 and article 8300. Furthermore, depending on the shape of the support structure 8200, there may be more or less than four of the reinforcement brackets 8400 coupled thereto.

Figure 25B:
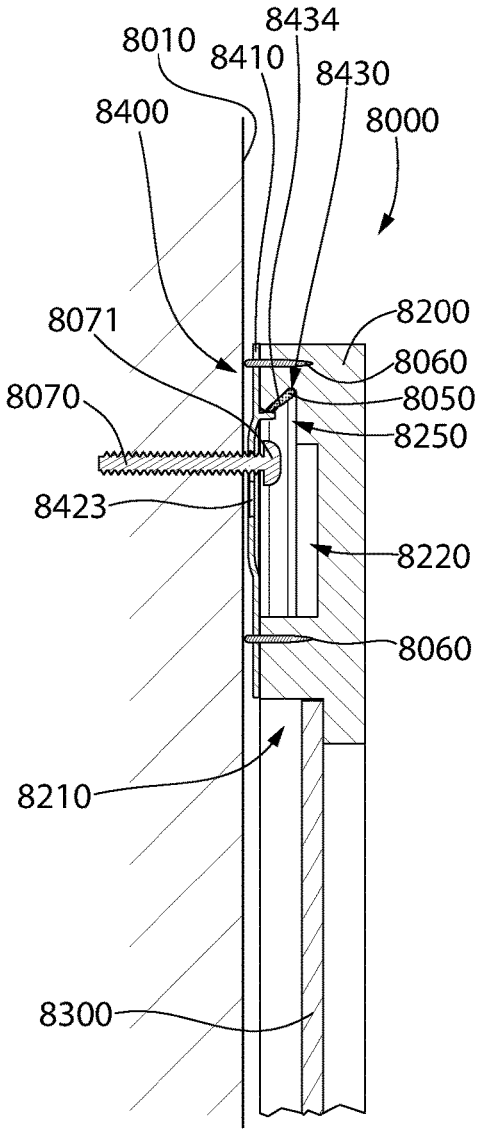
FIGS. 25 and 26 illustrate the process of leaning the support structure of FIG. 19 against a support surface and coupling the support structure thereto.
Figure 25:
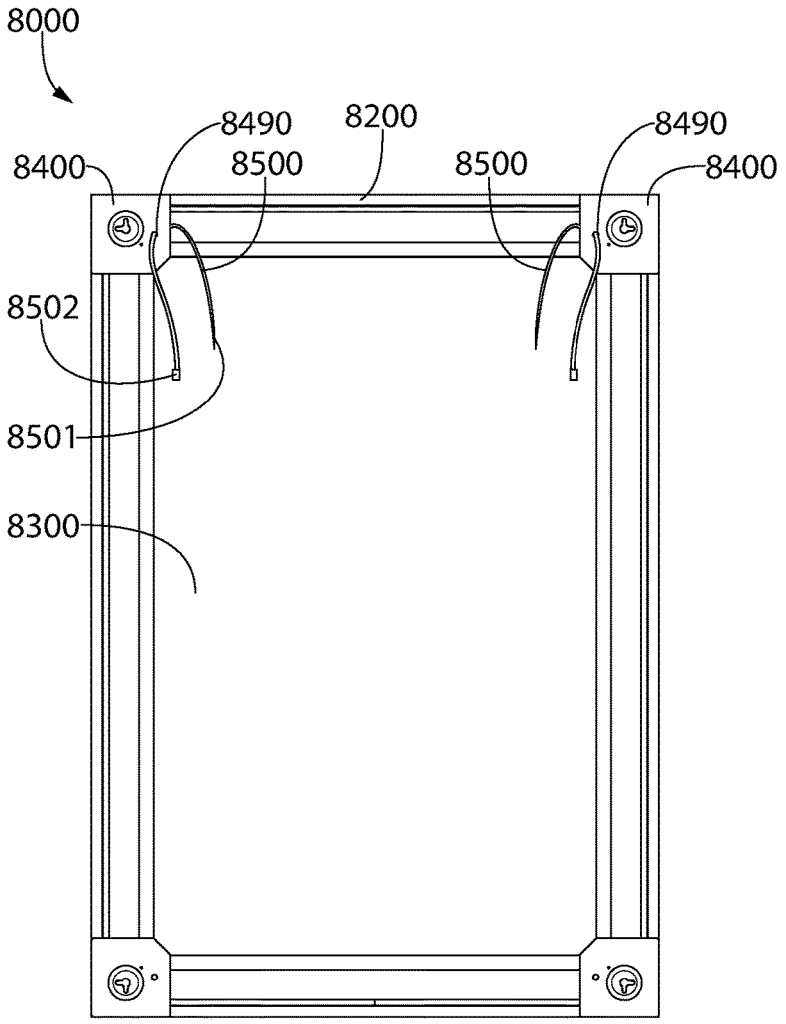
Figure 26:
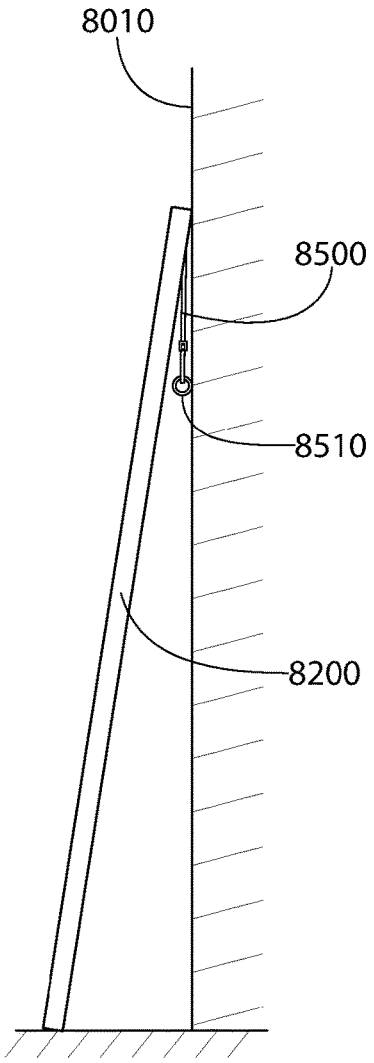

Referring to FIGS. 25 and 26, another technique for coupling the hanging apparatus 8000 to the support surface 8010 will be described. In FIGS. 25 and 26, the hanging apparatus 8000 is made to lean against the support surface 8010 while a bottom end of the hanging apparatus 8000 rests atop a horizontal surface such as the floor in an interior space, a desktop, a countertop, or the like. Thus, using the technique described with reference to FIGS. 25 and 26, the hanging apparatus 8000 may be supported in a position such that it is leaning against the wall (or other support surface 8010) rather than hanging from the wall (or other support surface).

Referring to FIG. 25, a rear view of the hanging apparatus 8000 is provided whereby a tie member 8500 is looped around each of the reinforcement brackets 8400 via the hole 8490. The tie members 8500 may be cable ties such as wire ties, hose ties, steggle ties, zap straps, zip ties, or the like. The tie members 8500 may be formed from metal, plastic, nylon, stainless steel, or the like in various embodiments. The tie members 8500 may in some embodiments be hanging wire comprising strand braided wire.

Next, referring to FIG. 26, a screw eye 8510 is coupled to the support surface 8010 at a desired position, which in some embodiments may be between 6 inches and 10 inches below a top edge of the support structure 8200 when the support structure 8200 is leaning against the support surface 8010 at the desired orientation. A free end 8501 of the tie member 8500 is then looped through the screw eye 8510 and inserted into a locking end 8502 of the tie member 8500 to secure the tie member 8500 to the screw eye 8510. In this manner, the hanging apparatus 8000 can be secured to the support surface 8010 in a leaning position/orientation.

Figure 27:
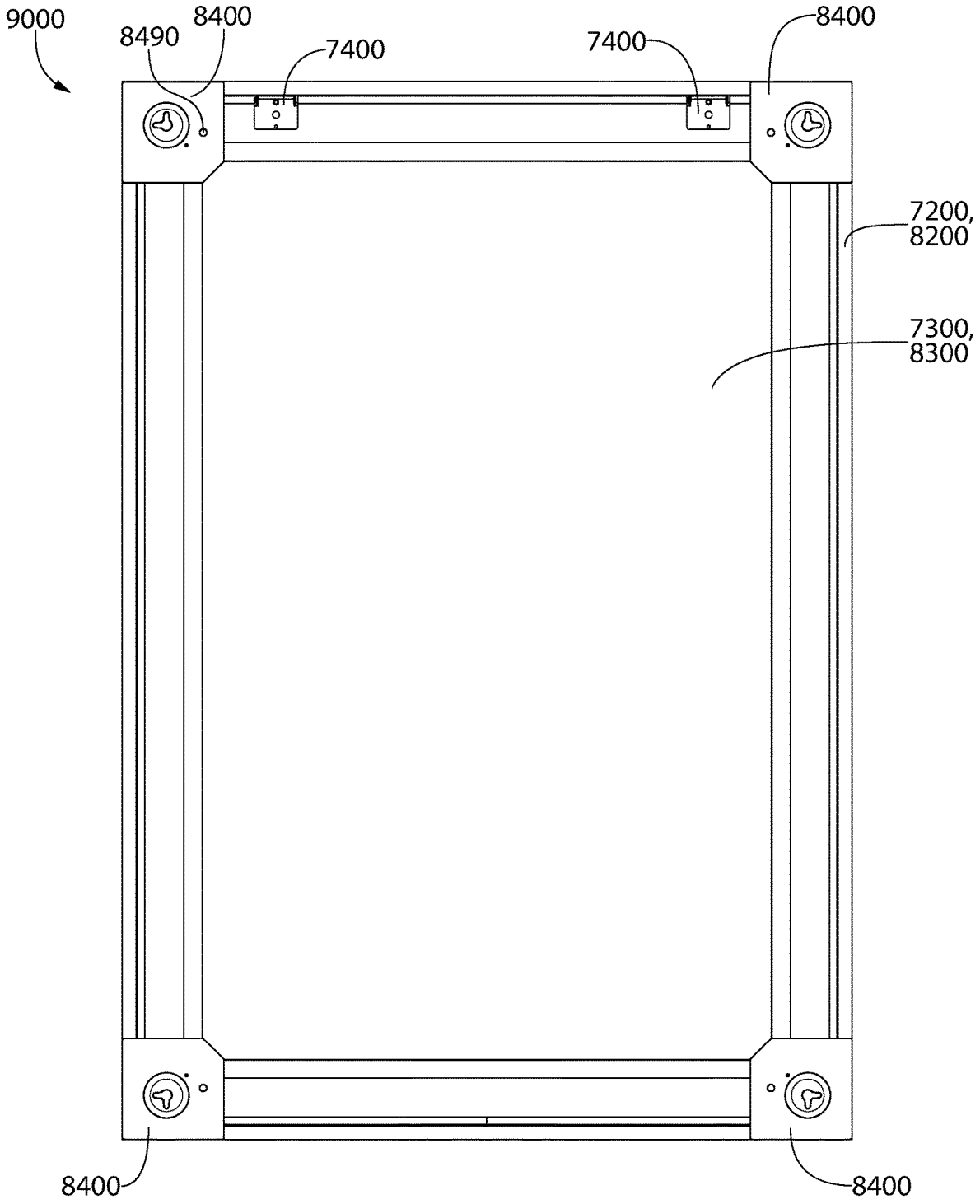
FIG. 27 is a rear view of a hanging system in accordance with another embodiment of the present invention, the hanging system including a support structure, two of the hanging brackets of FIGS. 3A-3D, and four of the reinforcement brackets of FIGS. 21A-21E.

Finally, referring to FIG. 27, a hanging system 9000 is illustrated in accordance with yet another embodiment of the present invention. The hanging system 9000 comprises the support structure 7200, 8200, the article 7300, 8300, two of the hanging brackets 7400 coupled to the support structure 7200, 8200, and four of the reinforcement brackets 8400 coupled to the support structure 7200, 8200. As mentioned previously, the support structure 7200 and the support structure 8200 are identical, and thus both are configured to be used along with the hanging brackets 7400 and the reinforcement brackets 8400. Therefore, in some embodiments, the hanging system 9000 may include both the hanging brackets 7400 as described herein above for hanging the support structure 7200, 8200 from a support surface in a manner that enables the support structure 7200, 8200 to slide side-to-side along the support surface and the reinforcement brackets 8400 as described herein above for providing structural rigidity/reinforcement to the support structure

7200, 8200 and enabling the support structure 7200, 8200 to be hung from the support surface in a stationary manner.

Allowing for both the hanging brackets 7400 and the reinforcement brackets 8400 to be included on the same support structure 7200, 8200 provides the end-user with options for hanging of the support structure 7200, 8200. Specifically, the support structure 7200, 8200 can be hung using the hanging brackets 7400, which allow for side-to-side movement of the support structure 7200, 8200 as it is hanging on the support surface. Alternatively, the support structure 7200, 8200 can be hung using the reinforcement brackets 8400, which provides for a more robust and stationary hanging of the support structure 7200, 8200 on the support surface. And finally, the support surface 7200, 8200 can be put in a leaning position and secured to the support surface using the holes 8490 in the reinforcement brackets 8400 and the tie members as described above with reference to FIGS. 25 and 26.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A hanging system comprising:

a support structure having a rear surface, the support structure comprising:

a rabbet for supporting an article;

a mounting channel defined by a floor, a first upstanding wall extending from the floor to the rear surface, and a second upstanding wall extending from the floor to the rear surface, the first upstanding wall separating the mounting channel from the rabbet; and a mounting groove formed into an inner surface of the second upstanding wall, the mounting groove comprising a mounting surface that extends obliquely from the rear surface of the support structure;

a hanging bracket comprising a first portion, a ledge portion, and a second portion, the hanging bracket being a monolithic; structure that comprises the first and second portions and the ledge portion, wherein the hanging bracket is configured to be coupled to a support surface with the first portion contacting the support surface, the ledge portion protruding from the support surface such that a portion of the ledge portion is oriented perpendicularly with respect to the support surface, and the second portion protruding obliquely from the support surface; and wherein at least a portion of the second portion of the handing bracket is positioned within the mounting groove of the support structure and a portion of the support structure rests atop of the ledge portion of the hanging bracket to mount the support structure to the hanging bracket and thereby hang the support structure from the support surface.

2. The hanging system according to claim 1 further comprising a second hanging bracket coupled to the support surface so that a second portion of the second hanging bracket protrudes obliquely from the support surface, the second portion of the second hanging bracket positioned within the mounting groove of the support structure to mount the support structure to the second hanging bracket, wherein the support structure is configured to slide side-to-side in a level manner along the support surface while remaining mounted to the hanging bracket and the second hanging bracket.

3. The hanging system according to claim 1 wherein the first upstanding wall has an inner surface that faces the rabbet and an outer surface that faces the mounting channel, and wherein the second upstanding wall comprises the inner surface that faces the mounting channel and an outer surface that forms an outer surface of the support structure.

4. The hanging system according to claim 1 wherein at least a portion of the second portion of the hanging bracket nests within the mounting groove of the support structure, a remainder of the hanging bracket being located external to the mounting channel of the support structure.

5. The hanging system according to claim 1 wherein the first portion of the hanging bracket comprises a front surface and a rear surface, the second portion of the hanging bracket extending obliquely from the front surface of the first portion of the hanging bracket.

6. The hanging system according to claim 5 further comprising a protrusion extending from the rear surface of the first portion of the hanging bracket, the protrusion comprising a pointed tip so that the protrusion can penetrate the support surface to temporarily couple the hanging bracket to the support surface.

7. The hanging system according to claim 6 further comprising an opening formed through the first portion of the hanging bracket, the opening configured to receive a fastener for coupling the hanging bracket to the support surface.

8. The hanging system according to claim 6 wherein the protrusion has a length measured from the rear surface of the first portion of the hanging bracket to the pointed tip, the length being between 2 mm and 5 mm.

9. The hanging system according to claim 1 wherein the first portion of the hanging bracket comprises a first lateral edge and a second lateral edge, and the hanging bracket further comprising a first visual alignment feature located at or adjacent to the first lateral edge and a second visual alignment feature located at or adjacent to the second lateral edge, the first and second visual alignment features being in vertical alignment with one another so that a horizontal reference plane intersects both of the first and second visual alignment features, wherein the first visual alignment feature is a first protuberance and the second visual alignment feature is a second protuberance.

10. The hanging system according to claim 1 wherein the hanging bracket comprises a bottom end, a top end, a first lateral edge, and a second lateral edge, and wherein the hanging bracket comprises a cross-sectional profile taken along a reference plane that intersects the bottom and top ends and is equidistant to the first and second lateral edges, the cross-sectional profile comprising a vertical portion extending from the bottom end of the hanging bracket to a second end of the vertical portion, a horizontal portion extending from the second end of the vertical portion to a second end of the horizontal portion, and an oblique portion extending from the second end of the horizontal portion to the top end of the hanging bracket, wherein when the support structure is mounted to the support surface with the hanging bracket, an edge of the support structure located at an intersection of the rear surface of the support structure and the mounting groove of the support structure rests atop the horizontal portion of the hanging bracket to maintain a gap between the support surface and a portion of the rear surface of the support structure formed by the second upstanding wall.

11. The hanging system according to claim 1 wherein the second portion of the hanging bracket comprises first and second legs coupled to a top end of the first portion in a spaced apart manner and a central portion extending between the first and second legs, the ledge portion being located between the first and second legs of the second portion and between the top end of the first portion and the central portion of the second portion.

12. The hanging system according to claim 11 wherein an edge at an intersection of the rear surface of the support structure and the mounting surface of the mounting groove rests atop of the ledge portion of the hanging bracket when the support structure is hanging from the hanging bracket.

13. The hanging system according to claim 1 wherein a gap exists between the rear surface of the support structure and the support surface when the hanging bracket is coupled to the support surface and the support structure is mounted to the hanging bracket.

14. A hanging system comprising:

a hanging apparatus comprising:

a support structure comprising:

a front surface, a rear surface opposite the front surface, and an outer surface extending between the front and rear surfaces;

a rabbet; and a mounting groove comprising a mounting surface that extends obliquely from the rear surface towards the front and outer surfaces; and an article located within the rabbet and coupled to the support structure;

a hanging bracket comprising:

a first portion comprising a bottom end, a top end, a front surface, and a rear surface;

a second portion that extends obliquely from the front surface of the first portion at the top end of the first portion, the second portion having an upper surface that is configured to support the support structure and a lower surface opposite the upper surface, the second portion further comprising a first leg coupled to the top end of the first portion and a second leg coupled to the top end of the first portion, the first and second legs being spaced apart from one another; and an L-shaped third portion located between the first and second legs of the second portion, the L-shaped third portion coupled to the top end of the first portion and to a central portion of the second portion that extends between the first and second legs;

wherein the hanging bracket is configured to be coupled to a support surface with the rear surface of the first portion contacting the support surface and the second portion protruding obliquely from the support surface; and wherein the hanging apparatus is configured to be mounted to the support surface by nesting at least the central portion of the second portion of the hanging bracket within the mounting groove of the support structure.

15. The hanging system according to claim 14 further comprising a protrusion extending from the rear surface of the first portion hanging bracket, the protrusion comprising a pointed tip so that the protrusion can penetrate the support surface to temporarily couple the hanging bracket to the support surface.

16. The hanging system according to claim 15 further comprising an opening formed through the first portion of the hanging bracket, the opening configured to receive a fastener for coupling the hanging bracket to the support surface.

17. The hanging system according to claim 14 further comprising a second hanging bracket coupled to the support surface so that a second portion of the second hanging bracket protrudes obliquely from the support surface, the second portion of the second hanging bracket positioned within the mounting groove of the support structure to mount the support structure to the second hanging bracket, wherein the hanging apparatus is configured to slide side-to-side in a level manner along the support surface while remaining mounted to the hanging bracket and the second hanging bracket.

18. The hanging system according to claim 14 wherein the article is a mirror.

19. The hanging system according to claim 14 wherein the hanging bracket comprises a bottom end, a top end, a first lateral edge, and a second lateral edge, and wherein the hanging bracket comprises a cross-sectional profile taken along a reference plane that intersects the bottom and top ends and is equidistant to the first and second lateral edges, the cross-sectional profile comprising a vertical portion extending from the bottom end of the hanging bracket to a second end of the vertical portion, a horizontal portion extending from the second end of the vertical portion to a second end of the horizontal portion, and an oblique portion extending from the second end of the horizontal portion to the top end of the hanging bracket, wherein when the support structure is mounted to the support surface with the hanging bracket, an edge of the support structure located at an intersection of the rear surface of the support structure and the mounting groove of the support structure rests atop the horizontal portion of the hanging bracket to maintain a gap between the support surface and a portion of the rear surface of the support structure.

20. A The hanging system comprising:

a hanging apparatus comprising:

a support structure comprising:

a front surface, a rear surface opposite the front surface, and an outer surface extending between the front and rear surfaces;

a rabbet; and a mounting groove comprising a mounting surface that extends obliquely from the rear surface towards the front and outer surfaces; and an article located within the rabbet and coupled to the support structure;

a hanging bracket comprising:

a first portion comprising a bottom end, a top end, a front surface, and a rear surface; and a second portion that extends obliquely from the front surface of the first portion at the top end of the first portion, the second portion having an upper surface that is configured to support the support structure and a lower surface opposite the upper surface;

wherein the hanging bracket is configured to be coupled to a support surface with the rear surface of the first portion contacting the support surface and the second portion protruding obliquely from the support surface;

wherein the hanging apparatus is configured to be mounted to the support surface by nesting at least a portion of the second portion of the hanging bracket within the mounting groove of the support structure; and wherein the hanging bracket further comprises a first reinforcement rib and a second reinforcement rib, each of which is connected to the front surface of the first portion of the hanging bracket and to the lower surface of the second portion of the hanging bracket, further comprising a first visual alignment feature located on the first reinforcement rib and a second visual alignment feature located on the second reinforcement rib, the first and second visual alignment features being in vertical alignment so that a horizontal reference plane intersects both of the first and second visual alignment features, wherein the first and second visual alignment features are protuberances protruding from the first and second reinforcement ribs in a direction towards first and second lateral edges of the hanging bracket, respectively.

* * * * *